US007149459B2

(12) United States Patent
Kamijo et al.

(10) Patent No.: US 7,149,459 B2
(45) Date of Patent: Dec. 12, 2006

(54) APPLICATION ROLLER AND IMAGE FORMING APPARATUS

(75) Inventors: Koichi Kamijo, Nagano-ken (JP); Hidehiro Takano, Nagano-ken (JP); Ken Ikuma, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/260,889

(22) Filed: Oct. 26, 2005

(65) Prior Publication Data

US 2006/0099011 A1 May 11, 2006

(30) Foreign Application Priority Data

Nov. 10, 2004 (JP) ..... 2004-325961
Nov. 30, 2004 (JP) ..... 2004-345338

(51) Int. Cl.
*G03G 15/10* (2006.01)

(52) U.S. Cl. ..... 399/239

(58) Field of Classification Search ..... 399/239, 399/237

See application file for complete search history.

(56) References Cited

U.S. PATENT DOCUMENTS 4,024,838 A * 5/1977 Horie ..... 399/239
6,067,433 A * 5/2000 Kimura et al. ..... 399/274
6,775,506 B1 * 8/2004 Endoh et al. ..... 399/284
6,795,674 B1 * 9/2004 Endoh et al. ..... 399/284
7,006,779 B1 * 2/2006 Otani ..... 399/258
2004/0265010 A1 * 12/2004 Otani ..... 399/258
2004/0265014 A1 * 12/2004 Takeuchi et al. ..... 399/274

FOREIGN PATENT DOCUMENTS

JP 2002-072692 3/2002
JP 2002072692 A * 3/2002

* cited by examiner

*Primary Examiner*—David M. Gray
*Assistant Examiner*—Geoffrey T Evans
(74) *Attorney, Agent, or Firm*—Hogan & Hartson LLP

(57) ABSTRACT

An application roller comprises inclined sections which monotonously extend from central parts of peaks to the bottom of grooves. Hence, a liquid developer (a carrier liquid and toner particles) remaining on wall surfaces of the grooves of the application roller and the like without moving to a developer roller from the application roller, due to its own gravity, moves to the bottom of the grooves while applied upon the developer roller, and stays at inner bottom parts of the grooves. This effectively prevents air from getting trapped in the grooves during carrying of the liquid developer to the grooves, and hence, permits carrying of an appropriate amount of the liquid developer.

6 Claims, 15 Drawing Sheets

APPLICATION ROLLER AND IMAGE FORMING APPARATUS

CROSS REFERENCE TO RELATED APPLICATION

The disclosure of Japanese Patent Applications enumerated below including specification, drawings and claims is incorporated herein by reference in its entirety:

No. 2004-325961 filed Nov. 10, 2004; and

No. 2004-345338 filed Nov. 30, 2004.

BACKGROUND OF THE INVENTION

1. Field of the Invention

The present invention relates to an electrophotographic image forming technique for a printer, a copier machine, a facsimile machine and the like, and more particularly, to an image forming technique which uses a liquid development method as a development method.

2. Description of the Related Art

Known as image forming apparatuses which use a liquid development method include a structure in which a liquid developer applied uniformly upon a surface of a developer roller (liquid developer carrier) develops an electrostatic latent image created on a latent image carrier and an image which is not uneven (toner image) is created. The following have been proposed as a technique to uniformly applying a liquid developing agent upon a surface of a developer roller. For instance, in the apparatus described in Japanese Unexamined Patent Application Publication No. 2002-72692, after scooping up a liquid developing agent with an anilox roller (application roller) whose surface has concave sections, a regulating member abuts on the anilox roller, and the amount of the liquid developing agent on the anilox roller is restricted. The regulating member abutting on the anilox roller, imposing a restriction in this manner, scrapes off the liquid developing agent from the surface of the anilox roller, leaving only the liquid developing agent carried in the concave sections of the surface of the anilox roller. Hence, the amount of the liquid developing agent on the anilox roller is measured accurately to a value which corresponds to the capacity of the concave sections. As the liquid developing agent accurately measured in this fashion is applied upon the developer roller, the accurately measured liquid developing agent is transferred to the developer roller and a uniform layer of the liquid developing agent is formed on the developer roller (See Patent Literature 1 for instance.).

SUMMARY OF THE INVENTION

Use of the conventional structure descried above however could result in an uneven toner image and hence a deteriorated image quality. The inventors of the invention, through intensive research, have found that one of the causes of a worsened image quality is a disturbed pattern of a liquid developing agent applied upon a liquid developer carrier by an application roller.

Further, in the conventional apparatus descried above, when the concave sections of the surface of the application roller carry the liquid developing agent, the concave sections may not be filled entirely up with the liquid developing agent sometimes, particularly at the bottom of the concave sections where air gets trapped. An image forming apparatus which uses a relatively thick liquid developing agent for instance is apparently prone to this phenomenon. The air contained in the liquid developing agent within the concave section may move even to a front layer portion of the liquid developing agent which is carried in the concave sections while the application roller rotates and the liquid developing agent is transported to the liquid developer carrier (i.e., to the application position). When this occurs, the liquid developing agent which is carried in the concave sections fails to reach the liquid developer carrier, which serves as one of the causes of a disturbed pattern of the liquid developing agent applied upon the liquid developer carrier. When an electrostatic latent image formed on the latent image carrier is developed with the liquid developing agent held as a disturbed pattern on the liquid developer carrier, a resulting toner image may become uneven and the image quality may therefore deteriorate.

The invention has been made in light of these problems, and accordingly, a first object of the invention is to provide an application roller which prevents inclusion of air in concave sections during the process of carrying a liquid in the concave sections and which hence holds an appropriate amount of the liquid.

A second object of the invention is to provide an image forming apparatus which prevents disturbance of a pattern in which an application roller applies a liquid developing agent upon a liquid developer carrier, accordingly enhances the accuracy of development and improves the image quality of a resultant toner image.

The present invention is directed to a application roller which has a surface which carries a liquid and comes into contact with a regulating member, whereby an excessive amount of the liquid on the surface of the application roller is scraped off. According a first aspect of the present invention, the application roller which transports a liquid to an application position, at which said application roller contacts an element-to-be-coated, while carrying said liquid onto its surface, and applies said liquid upon said element-to-be-coated, the roller comprising: concave sections which are formed in the surface and carry said liquid; convex sections which are formed in the surface; and inclined sections which monotonously extend from central parts of said convex sections to bottom parts of said concave sections, wherein the height of the central parts of said convex sections measured from bottom parts of said concave sections is higher than the height of edge parts of said convex sections.

The present invention is also directed to an image forming apparatus using liquid development. According to a second aspect of the present invention, the image forming apparatus, comprising: (a) a latent image carrier which carries an electrostatic latent image; and (b) a developing unit which comprises (b-1) the application roller of claim 1, (b-2) a regulating member which contacts said application roller, scrapes off an excessive amount of a liquid developing agent carried on said application roller and regulates the amount of said liquid developing agent carried on said application roller, and (b-3) a liquid developer carrier upon which said application roller applies said liquid developing agent which has been regulated by said regulating member, and which develop said electrostatic latent image on said latent image carrier with said liquid developing agent carried on said liquid developer carrier, thereby forming a toner image.

The present invention is also directed to an image forming apparatus in which after application of the liquid developing agent to a developing agent carrier, an electrostatic latent image on a latent image carrier is developed using the liquid developing agent which is carried by the developing agent carrier and a toner image is formed. According to a third aspect of the present invention, the image forming apparatus which develops an electrostatic latent image on a latent image carrier using a liquid developing agent which is carried on a liquid developer carrier and which forms a toner image, the apparatus comprising: (a) an application roller which is disposed for free rotations along a first direction, has concave sections and convex sections in a surface of said application roller, transports said liquid developing agent to an application position, at which said application roller contacts said liquid developer carrier, while carrying said liquid developing agent in said concave sections and applies said liquid developing agent upon said liquid developer carrier; and (b) a regulating member which is disposed in contact with said application roller on the upstream side along the first direction relative to said application position and which regulates the amount of said liquid developing agent carried on said application roller, wherein a second condition of R1<R4<R2 is satisfied where the symbol R1 denotes the surface roughness of said convex sections within said surface of said application roller, the symbol R2 denotes the surface roughness of said concave sections and the symbol R4 denotes the surface roughness of a portion of said regulating member which contacts at least said application roller.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

<First Embodiment>

Figure 1:
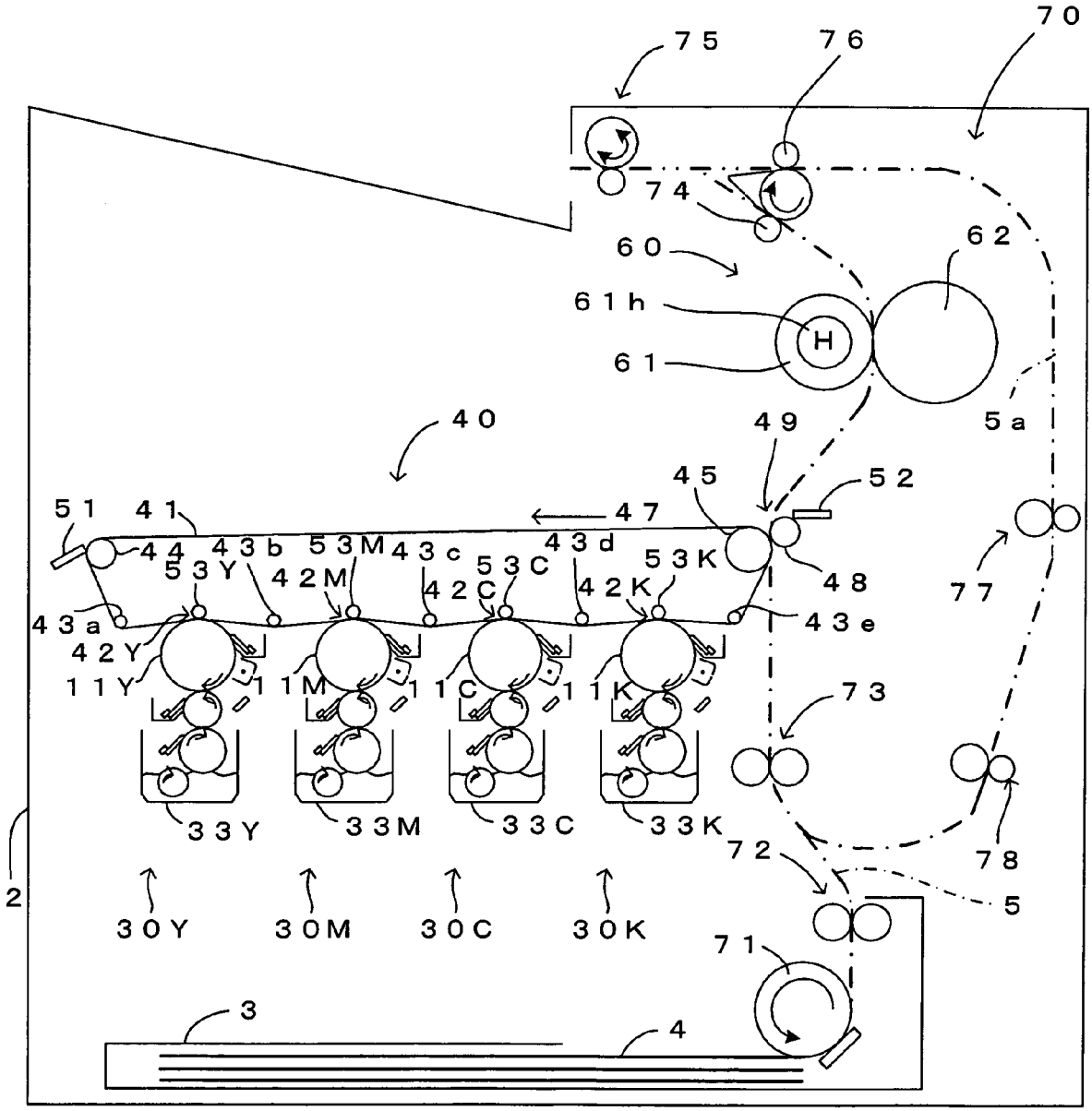
FIG. 1 is a drawing which shows the internal structure of a printer, a first embodiment of an image forming apparatus according to the invention.
Figure 2:
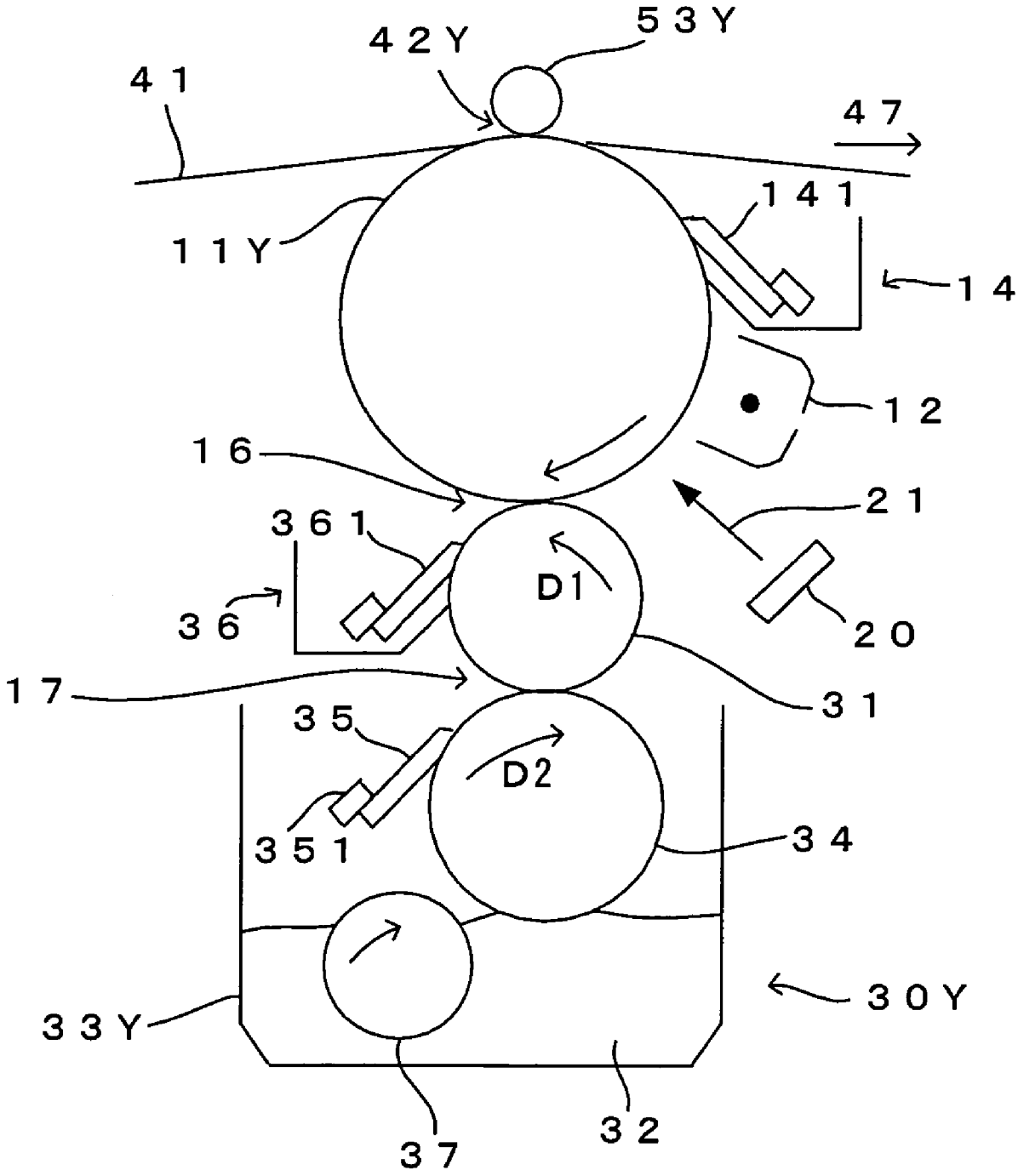
FIG. 2 is an enlarged view of an essential part in FIG. 1.
Figure 3:
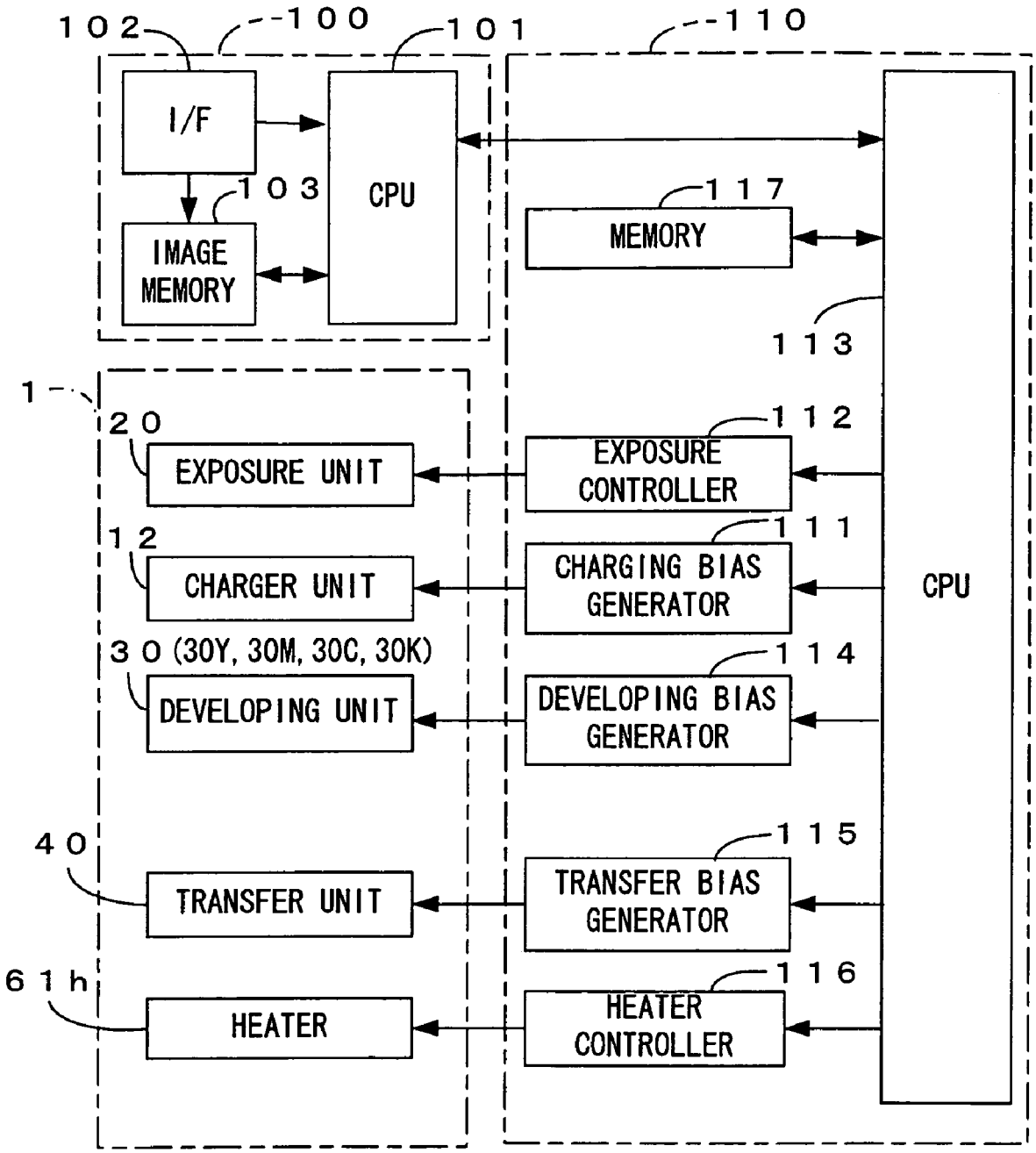
FIG. 3 is a block diagram which shows the electric structure of the printer.

FIG. 1 is a drawing which shows the internal structure of a printer, a first embodiment of an image forming apparatus according to the invention. FIG. 2 is an enlarged view of an essential part in FIG. 1, and FIG. 3 is a block diagram which shows the electric structure of the printer. This image forming apparatus is a color printer of the so-called tandem type, and photosensitive members 11Y, 11M, 11C and 11K for the four colors of yellow (Y), magenta (M), cyan (C) and black (K) are disposed as the "latent image carrier" of the invention parallel to each other inside a main apparatus section 2. A liquid development method is implemented in this printer, to thereby superimpose toner images carried on the photosensitive members 11Y, 11M, 11C and 11K upon each other and form a full color image, or form a monochrome image using a black (K) toner image alone. In this printer, as a print command signal containing an image signal is fed to a main controller 100 from an external apparatus such as a host computer, an engine controller 110 controls respective portions of an engine part 1 in accordance with a control signal received from the main controller 100, and an image which corresponds to the image signal is printed on a recording medium 4, which may be a transfer paper, a copy paper or a transparency for an overhead projector, which is transported from a paper feed cassette 3 which is disposed in a lower portion of the main apparatus section 2.

In the engine part 1, a charger unit 12, an exposure unit 20, a developing unit 30 (30Y, 30M, 30C, 30K, which corresponds to the "developing unit" of the invention) and a photosensitive unit cleaner 14 are disposed respectively for the four photosensitive members 11Y, 11M, 11C and 11K disposed parallel to each other along the direction of rotations 47 of an intermediate transfer belt 41 which is one part of a transfer unit 40. Each one of the developing units 30Y, 30M, 30C and 30K comprises a tank 33 (33Y, 33M, 33C, 33K) which stores a liquid developer 32 in which toner of each color is dispersed. The structures of the charger unit 12, the exposure unit 20, the developing unit 30 and the photosensitive unit cleaner 14 are the same across all toner colors. Hence, the structures for yellow alone will be described below, and those for the other toner colors will be simply denoted at the same or corresponding reference symbols but will not be described.

As shown in FIG. 2, the photosensitive member 11Y is disposed for free rotations in the direction of the arrow (the clockwise direction in FIG. 2), and the diameter of the photosensitive member 11Y is approximately 40 mm. Around the photosensitive member 11Y, the charger unit 12, a developer roller 31, a discharger (not shown) and the photosensitive unit cleaner 14 are disposed along the direction of rotations of the photosensitive member 11Y A surface area between the charger unit 12 and a development position 16 is an irradiation area which comes under a light beam 21 from the exposure unit 20. The charger unit 12 uniformly charges up an outer peripheral surface of the photosensitive member 11Y to a predetermined surface potential Vd (Vd=DC+600V for instance) upon application of a charging bias from a charging bias generator 111, and functions as a charger.

The exposure unit 20 irradiates the light beam 21 of laser for example toward the outer peripheral surface of the photosensitive member 11Y thus uniformly charged by the charger unit 12. The exposure unit 20 exposes the photosensitive member 11Y with the light beam 21 in accordance with a control command fed from an exposure controller 112 to form on the photosensitive member 11Y a yellow electrostatic latent image which corresponds to the image signal. When a print command signal containing an image signal is fed to a CPU 101 of the main controller 100 from an external apparatus such as a host computer via an interface 102 for instance, in response to a command from the CPU 101 of the main controller 100, a CPU 113 outputs a control signal suitable to this image signal to the exposure controller 112 at predetermined timing. The exposure unit 20 irradiates the photosensitive member 11Y with the light beam 21 in accordance with a control command from the exposure controller 112, whereby a yellow electrostatic latent image which corresponds to the image signal is formed on the photosensitive member 11Y (latent image formation step). When a patch image needs be formed, the CPU 113 provides the exposure controller 112 with a control signal corresponding to a image signal which expresses a predetermined pattern (e.g., a solid image, a thin line image, a white thin line image, registration mark), and a yellow electrostatic latent image which corresponds to this pattern is formed on the photosensitive member 11Y.

The yellow electrostatic latent image formed in this manner is visualized with yellow toner which is supplied from the developer roller 31 of the developing unit 30Y (developing step). The yellow toner image formed on the photosensitive member 11Y is transported to a primary transfer position 42Y which is opposed against a primary transfer roller 53Y, as the photosensitive member 11Y rotates. The primary transfer roller 53Y is located such that the intermediate transfer belt 41 comes between the primary transfer roller 53Y and the photosensitive member 11Y Further, the intermediate transfer belt 41 runs across plural rollers 43*a* through 43*e*, 44, 45, and when driven by a drive motor not shown, rotates in the direction 47 (the counter-clockwise direction in FIG. 1) which follows the photosensitive member 11Y at the same peripheral speed as the photosensitive member 11Y. Upon application of a primary transfer bias (which may be DC—400V, for instance) from a transfer bias generator 115, the yellow toner image on the photosensitive member 11Y is primarily transferred onto the intermediate transfer belt 41 at the primary transfer position 42Y (transfer step).

The discharger formed by an LED or the like removes residual charges remaining on the photosensitive member 11Y after the primary transfer, and the photosensitive unit cleaner 14 removes the residual liquid developer. The photosensitive unit cleaner 14 comprises a photosensitive cleaning blade 141 of rubber which abuts on the surface of the photosensitive member 11Y, and the photosensitive cleaning blade 141 scrapes off and removes the liquid developer 32 which remains on the photosensitive member 11Y after the primary transfer of the toner image onto the intermediate transfer belt 41. The structure and the operation of the developing unit 30Y will be described in detail later.

Similar structures to that for yellow (Y) are used for the other toner colors, and toner images corresponding to the image signal are formed. The toner images in the respective colors of yellow (Y), magenta (M), cyan (C) and black (K) formed on the photosensitive members 11Y, 11M, 11C and 11K are primarily transferred at the primary transfer positions 42Y, 42M, 42C and 42K which are opposed against the primary transfer rollers 53Y, 53M, 53C and 53K and consequently superimposed one atop the other on the surface of the intermediate transfer belt 41, and a full color toner image is formed.

The toner image formed on the intermediate transfer belt 41 is transported to a secondary transfer position 49 which is between rollers 45 and 48, as the intermediate transfer belt 41 rotates. The recording medium 4 stored in the paper feed cassette 3 (FIG. 1) is transported to the secondary transfer position 49 by a transportation unit 70 will be described later, in synchronization to the transportation of the primarily transferred toner image. The roller 48 rotates in the direction (the clockwise direction in FIG. 1) which follows the intermediate transfer belt 41 at the same peripheral speed as the intermediate transfer belt 41, and upon application of a secondary transfer bias from the transfer bias generator 115, the toner image on the intermediate transfer belt 41 is secondarily transferred onto the recording medium 4. The roller 48 may be of urethane rubber whose hardness is about 50 in JIS-A scale and may have a diameter of about 25 mm. Since this embodiment achieves transfer using the rollers, a transfer condition may be set through constant voltage control or constant current control. Corona discharge may be used for transfer instead of using the rollers, in which case the output of corona discharge may be controlled to set a transfer condition. A cleaning blade 51 removes the residual liquid developer on the intermediate transfer belt 41 after the secondary transfer.

The recording medium 4 now seating the secondarily transferred toner image is transported along a predetermined transportation path 5 (denoted at the chain line in FIG. 1), and a fixing unit 60 fixes the toner image on the recording medium 4 which will then be discharged to a discharge tray which is disposed in an upper portion of the main apparatus section 2. The fixing unit 60 comprises a heat roller 61 equipped with a built-in heater 61*h* and a press roller 62 which contacts the heat roller 61. As a heater controller 116 controls activation of the heater 61*h*, a fixing temperature in the fixing unit 60 is adjusted to any desired temperature.

In this embodiment, the image forming apparatus further comprises the transportation unit 70 which transports the recording medium 4 along the predetermined transportation path 5. In the transportation unit 70, as shown in FIG. 1, a paper feed roller 71 is disposed for the paper feed cassette 3. With the paper feed roller 71, one recording medium 4 is retrieved at a time from the paper feed cassette 3 and transported to a feed roller 72. The feed roller 72 then transports the recording medium 4 to a gate roller 73, and the recording medium 4 is temporarily held stand-by at the position of the gate roller. The gate roller 73 is driven at timing for the secondary transfer operation described above, and feeds the recording medium 4 to the secondary transfer position 49. Disposed for the discharge tray are a pre-discharge roller 74, a discharge roller 75 and an inverting roller 76. The recording medium 4 as it is after the secondary transfer is transported to the discharge tray via the fixing unit 60, the pre-discharge roller 74 and the discharge roller 75.

The discharge roller 75 is capable of rotating forward and backward, noting the necessity of inverting the recording medium 4 and transporting the recording medium 4 back to the gate roller 73 again for double-side printing. In other words, when the recording medium 4 is to be discharged straight to the discharge tray, the discharge roller 75 keeps rotating forward and transports the recording medium 4 to the discharge tray completely. On the contrary, when inversion and re-feeding is needed, upon arrival of the rear end of the recording medium 4 at a predetermined position between the pre-discharge roller 74 and the discharge roller 75, the discharge roller 75 rotates backward and sends the recording medium 4 to the inverting roller 76. This transports the recording medium 4 back to a re-feed intermediate roller 77 along an inversion path 5*a*. The re-feed intermediate roller 77 and a re-feed pre-gate roller 78 transport the recording medium 4 to the gate roller 73, and the recording medium 4 is temporarily held stand-by at the position of the gate roller. The recording medium 4 is inverted and re-fed in this fashion. At this stage, the surface of the recording medium 4 which abuts on the intermediate transfer belt 71 and receives the transferred image is the opposite surface to the surface which has already received the earlier transferred image. The images are thus formed on the both surfaces of the recording medium 4. The surface of the recording medium 4 which has already received the earlier transferred image touches the roller 48 during the secondary transfer on the opposite surface, and toner not completely fixed to the recording medium 4 may adhere to the roller 48. A cleaning blade 52 removes the toner adhering to the roller 48 in this manner.

In FIG. 3, the main controller 100 comprises an image memory 103 which stores the image signal fed from an external apparatus via the interface 102. Receiving the print command signal containing the image signal from the external apparatus via the interface 102, the CPU 101 converts the print command signal into job data in a suitable format to instruct the engine part 1 to operate and sends the job data to the engine controller 110.

A memory 117 of the engine controller 110 is formed by a ROM which stores a control program for the CPU 113 including preset fixed data, a RAM which temporarily stores control data for the engine part 1, a computation result derived by the CPU 113, etc. The CPU 113 stores in the memory 117 data regarding the image signal sent from the external apparatus via the CPU 101.

Figure 4:
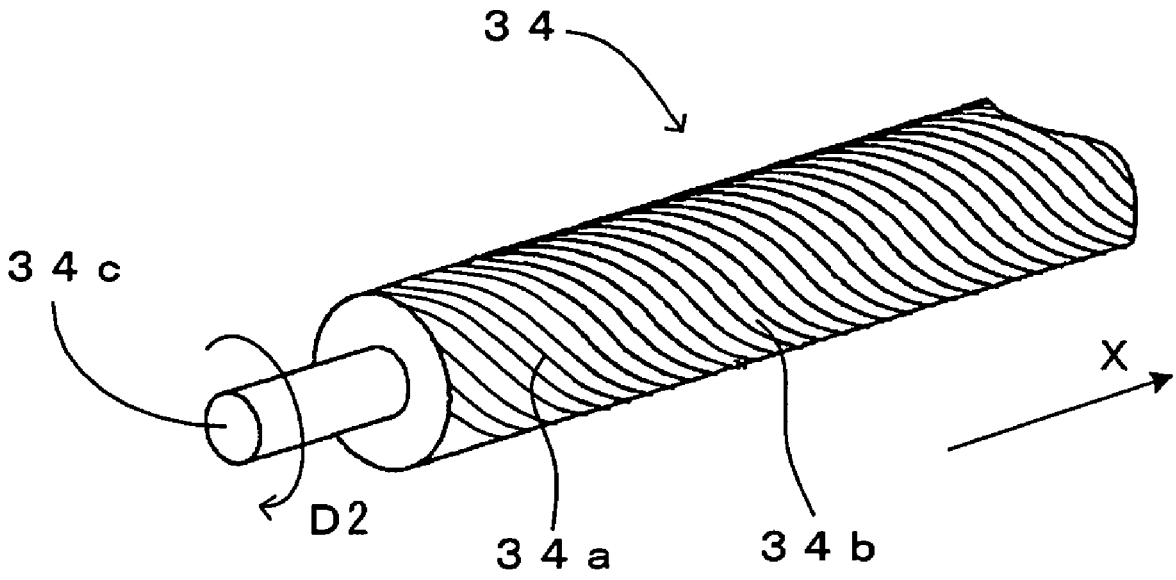
FIG. 4 is a conceptual perspective view of an anilox roller in which surface grooves are formed.
Figure 5:
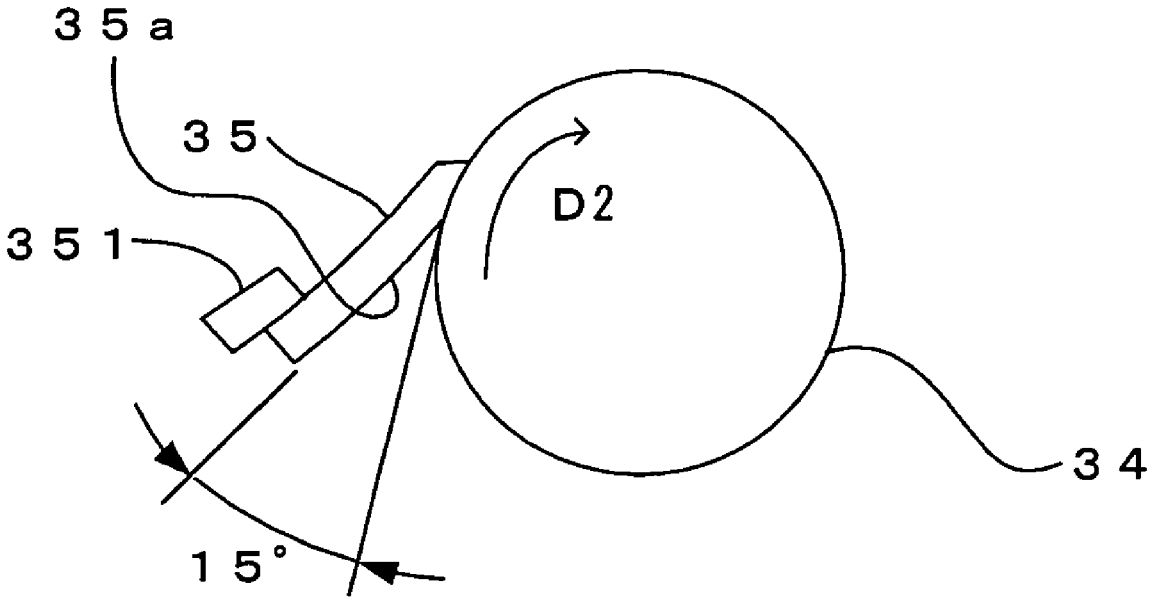
FIG. 5 is an enlarged schematic view of an application roller and a restricting blade.

The structure and operations of the developing unit 30Y will now be described in detail with reference to FIGS. 2, 4 and 5. FIG. 4 is a conceptual perspective view of an anilox roller in which surface grooves are formed, and FIG. 5 is an enlarged schematic view of an application roller and a restricting blade. The structures of the developing units 30M, 30C and 30K are similar to the structure of the developing unit 30Y, and therefore, will not be described in redundancy. Instead, the same structures will be denoted at the same or corresponding reference symbols.

In addition to a developer roller 31 (which corresponds to the "element-to-be-coated" and the "liquid developer carrier" of the invention), the developing unit 30Y comprises a tank 33Y which holds a liquid developer 32 in which yellow toner is dispersed, an agitating roller 37 which agitates the liquid developer 32 held in the tank 33Y, an application roller 34 which scoops up the liquid developer 32 and applies the same upon the developer roller 31, a restricting blade 35 which regulates the thickness of a layer of the liquid developer on the application roller 34 into a uniform thickness, and a developer roller cleaning part 36 which removes the liquid developer remaining on the developer roller 31 after supply of the toner to the photosensitive member 11Y. The developer roller 31 rotates in a direction D1 (which is shown as the counter-clockwise direction in FIG. 2) which follows the photosensitive member 11Y, approximately at the same peripheral speed as that of the photosensitive member 11Y. Meanwhile, the application roller 34 rotates in a direction D2 (which is shown as the clockwise direction in FIG. 2 and corresponds to the "first direction" of the invention) which follows the developer roller 31 about a rotation axis 34*c*, approximately at the same peripheral speed as that of the developer roller 31.

The liquid developer 32 (which corresponds to the "liquid" and the "liquid developing agent" of the invention) is obtained by dispersing in a carrier liquid toner consisting of a pigment whose average diameter is approximately from 0.1 to 5 μm, an adhesive such as epoxy resin which bonds this pigment, an electric charge control agent which applies a predetermined electric charge to toner, a dispersing agent which uniformly disperses the pigment, and the like. In this embodiment, the average diameter Dr of toner particles is R3*d*≈about 4 μm. This embodiment uses silicon oil such as polydimethylsiloxane oil for instance as the carrier liquid and sets the toner density to 5 through 40 wt % which is higher than that of a low-density liquid developer (having the toner density of 1 through 2 wt %) which is popular for liquid development methods. The type of the carrier liquid is not limited to silicon oil, and ISOPAR L (trade name) manufactured by EXXON CHEMICAL JAPAN or paraffin oil may be used for instance. The viscosity of the liquid developer 32, which is determined by the materials of the carrier liquid, the toner and the toner density, etc., is set to 100 through 10000 mPa·s for instance in this embodiment.

The gap between the photosensitive member 11Y and the developer roller 31 (namely, a development gap=the thickness of a layer of the liquid developer) is set to 5 through 40 μm for instance in this embodiment, and the development nip distance (which is a distance along the peripheral direction over which the liquid developer layer contacts both the photosensitive member 11Y and the developer roller 31) is set to 5 mm for example in this embodiment. While a development gap of 100 to 200 μm is necessary to secure the bulk of toner where a low-density liquid developer like the one mentioned above is used, the development gap is short in this embodiment because of the high-density liquid developer. This shortens a distance which the toner moves in the liquid developer due to electrophoresis, and further, since a stronger electric field develops even at the same developing bias, more efficient and faster development is attained.

The agitating roller 37 scoops up the liquid developer 32 which is held in the tank 33Y, and transports the same to the application roller 34. A lower portion of the agitating roller 37 is dipped in the liquid developer 32 which is held in the tank 33Y, and the agitating roller 37 is away from the application roller 34 over a distance of about 1 mm. The agitating roller 37 is capable of rotating about its central axis which is located below the central axis of rotations of the application roller 34. The agitating roller 37 rotates in the same direction as the direction of rotations D2 (the clockwise direction in FIG. 2) of the application roller 34. Besides the function of scooping up the liquid developer 32 which is held in the tank 33Y and transporting the same to the application roller 34, the agitating roller 37 also has a function of agitating the liquid developer 32 so that the liquid developer 32 is kept in a proper condition. A metallic roller of iron for instance having a diameter of about 20 mm may be used as this agitating roller.

At an application position 17, the application roller 34 supplies to the developer roller 31 the liquid developer 32 which the agitating roller 37 has transported from the tank 33Y. As shown in FIG. 4, the application roller 34 is what is called an anilox roller of metal such as iron whose nickel-plated surface bears grooves 34a (which correspond to the "concave sections" of the invention) which are provided uniformly in a spiral arrangement, and the diameter of the application roller 34 is about 25 mm. In this embodiment, the multiple grooves 34*a* are formed diagonally with respect to the direction of rotations D2 of the application roller 34 through the so-called cutting process as shown in FIG. 4.

As the application roller 34 contacts the liquid developer 32 while rotating clockwise, the grooves 34*a* carry the liquid developer 32 and thus carried liquid developer 32 is transported to the developer roller 31. In this manner, over its X-direction width bearing the grooves 34*a*, the application roller 34 applies the liquid developer 32 to the developer roller 31. The groove pitches (i.e., the cycles in which peaks forming the grooves 34*a* appear along the direction (X-direction) of thrust (rotation axis)) are preferably 55 through 250 μm approximately in accordance with a required film thickness of the liquid developer 32. In this embodiment, the grooves are formed such that the groove pitches are about 170 μm, the width of the peaks is about 45 μm, the width of the grooves 34*a* is about 30 μm and the depth of the grooves 34*a* is about 50 μm. The peaks 34*b* between the grooves 34*a* in the surface of the application roller 34 correspond to the "convex sections" of the invention. Further, in this embodiment, the surface roughness Ra of the peaks 34*b* is R1*a*≈0.03 μm and the surface roughness Ra of the grooves 34*a* is R2*a*≈0.15 μm.

For proper application of the liquid developer 32 carried on the application roller 34 to the developer roller 31, the surface of the application roller 34 contacts under pressure a layer of an elastic member of the developer roller 31 which will be described later. The application roller 34 is capable of rotating about its central axis which is located below the central axis of rotations of the developer roller 31. The application roller 34 rotates in the opposite direction D2 (the clockwise direction in FIG. 2) to the direction of rotations (the counterclockwise direction in FIG. 2) of the developer roller 31.

On the upstream side to the application position 17 along the direction D2 in which the application roller 34 rotates, the restricting blade 35 (which corresponds to the "regulating member" of the invention) contacts at its belly the surface of the application roller 34 and restricts the amount of the liquid developer 32 on the application roller 34. That is, the restricting blade 35 scrapes off an excessive amount of the liquid developer 32 held on the peaks 34*b* within the surface of the application roller 34 and accordingly measures the amount of the liquid developer 32 which the application roller 34 supplies to the developer roller 31. The restricting blade 35 is made of urethane rubber which serves as an elastic member (whose modulus of elasticity is about 50 kg/cm$^2$ (100%)), and a restricting blade support member 351 of iron or other metal supports blade-shaped urethane rubber having a thickness of about 1.6 mm in the restricting blade 35. The rubber hardness of the restricting blade 35 is about 77 about on the JIS-A scale, and the hardness (approximately 77 degrees) of the restricting blade 35 in the abutting portion where the restricting blade 35 abuts on the surface of the application roller 34 is lower than the hardness (approximately 85 degrees) of the elastic member layer of the developer roller 31 which will be described later in the pressure-contact portion where the developer roller 31 is in contact under pressure with the surface of the application roller 34. In this embodiment, the restricting blade 35 is disposed such that its front tip is directed toward the downstream side along the direction of rotations of the application roller 34, for the purpose of so-called trail regulation. As shown in FIG. 5, where the contact angle is defined as the angle between the tangent line to an outer peripheral surface of the application roller 34 and a belly portion 35*a* of the restricting blade 35 at the contact position that the restricting blade 35 and the application roller 34 contact, the support member 351 supports the restricting blade 35 such that the contact angle is 15 degrees in this embodiment. In addition, the surface roughness Ra of the portion of the restricting blade 35 which contacts the application roller 34 is R4*a*≈0.06 μm in this embodiment. The details including how the restricting blade 35 contacts the application roller 34 in this contact portion will be described later.

To develop the electrostatic latent image carried on the photosensitive member 11Y with the liquid developer 32, the developer roller 31 carries and transports the liquid developer 32 to the development position 16 which is opposed against the photosensitive member 11Y. The developer roller 31 comprises, at the outer peripheral surface of the metallic inner core of iron or the like, the elastic member layer which is one example of the conductive elastic member, and the diameter of the elastic member layer is about 20 mm. The elastic member layer has a double-layer structure in which the inner layer is of urethane rubber whose hardness is about 30 degrees on the JIS-A scale and whose thickness is about 5 mm and the surface layer (outer layer) is of urethane rubber whose hardness is about 85 degrees on the JIS-A scale and whose thickness is about 30 μm. The surface layer of the developer roller 31 serves as the pressure-contact portion in which the developer roller 31 contacts under pressure, as it is elastically deformed, the application roller 34 and the photosensitive member 11Y The surface roughness Ra of the surface of the developer roller 31 is R5*a*≈0.4 μm.

The developer roller 31 is capable of rotating about its central axis which is located below the central axis of rotations of the photosensitive member 11Y. The developer roller 31 rotates in the opposite direction D1 (the counterclockwise direction in FIG. 2) to the direction of rotations of the photosensitive member 11Y During development of the electrostatic latent image formed on the photosensitive member 11Y, an electric field is created between the developer roller 31 and the photosensitive member 11Y.

The developer roller cleaner 36 comprises a developer roller cleaning blade 361 of rubber which abuts on the surface of the developer roller 31, along the direction of thrust (rotation axes) of the developer roller 31, on the downstream side to the development position 16 along the direction of rotations (the counterclockwise direction) of the developer roller 31. The developer roller cleaner 36 is a device which scrapes off, with its developer roller cleaning blade 361, the liquid developer 32 which remains on the developer roller 31 after development at the development position 16.

In this embodiment, the axis-to-axis distance between the rotation axes of the application roller 34 and those of the developer roller 31 is shorter than the sum of the radius of the application roller 34 and that of the developer roller 31 so as to favorably move the liquid developer 32 from the application roller 34 to the developer roller 31. Where the diameter of the application roller 34 is 25 mm and that of the developer roller 31 is 20 mm as described above, the axis-to-axis distance between the rotation axes of the application roller 34 and those of the developer roller 31 may be 22.3 mm for instance.

In the developing unit 30Y having this structure, as the agitating roller 37 rotates about its central axis, the liquid developer 32 in the tank 33Y is scooped up and transported to the application roller 34. The liquid developer 32 transported to the application roller 34 reaches an abutting position at which the restricting blade 35 abuts on, as the application roller 34 rotates. While moving passed the abutting position, an excessive amount of the liquid developer 32 gets scraped off by the restricting blade 35, and the amount of the liquid developer 32 to be supplied to the developer roller 31 is measured. That is, since the application roller 34 comprises the grooves 34*a* as described earlier, the restricting blade 35 abutting on the application roller 34 scrapes off the liquid developer 32 from the application roller 34, leaving the liquid developer 32 which remains carried in the grooves 34*a*. Further, since the dimensions of the grooves 34*a* are determined such that the amount of the liquid developer 32 supplied to the developer roller 31 will be appropriate, after the restricting blade 35 has scraped off the liquid developer 32 which is on the application roller 34, the proper amount of the liquid developer 32 measured by the grooves 34*a* stays in the grooves 34*a*.

The application roller 34 scoops up the liquid developer 32 which is held in the tank 33Y in this manner, the restricting blade 35 restricts the amount of the liquid developer 32 on the application roller 34 to the constant amount, the constant liquid developer 32 is applied to the surface of the developer roller 31 at the application position 17, and as the developer roller 31 rotates, the liquid developer 32 is transported to the development position 16 which is opposed against the photosensitive member 11Y. The toner inside the liquid developer 32 is positively charged for instance, due to the function of the electric charge control agent or the like. At the development position 16, the liquid developer 32 carried on the developer roller 31 is supplied from the developer roller 31 to and adheres to the photosensitive member 11Y, and a developing bias Vb (Vb=DC+400V for example) applied upon the developer roller 31 from a developing bias generator 114 moves the yellow toner from the developer roller 31 to the photosensitive member 11Y and the yellow electrostatic latent image is visualized. The liquid developer left on the developer roller 31 without adhering to the photosensitive member 11Y is scraped off by the developer roller cleaning blade 361.

The yellow toner image thus formed on the photosensitive member 11Y is primarily transferred onto the intermediate transfer belt 41 at the primary transfer position 42Y as described earlier, and the photosensitive unit cleaner 14 removes the residual liquid developer 32 remaining on the photosensitive member 11Y after the primary transfer.

Figure 6:
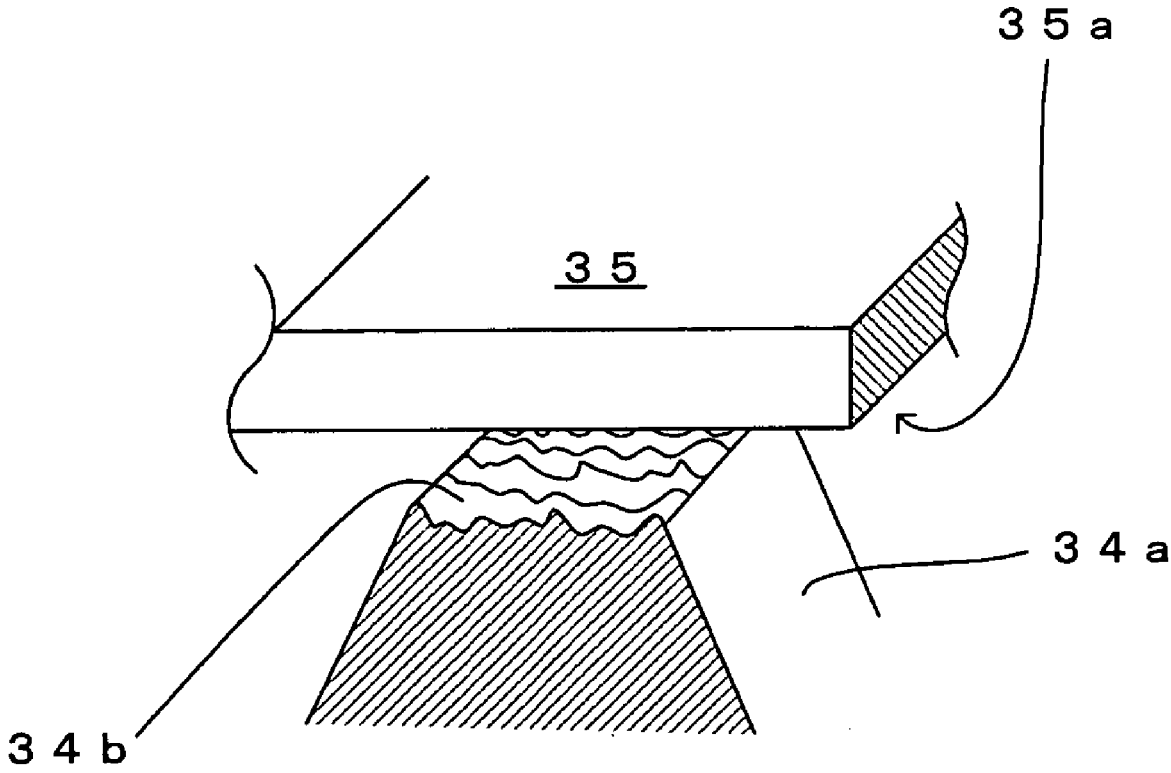
FIG. 6 is a partially enlarged view of the application roller and the restricting blade.
Figure 7A:
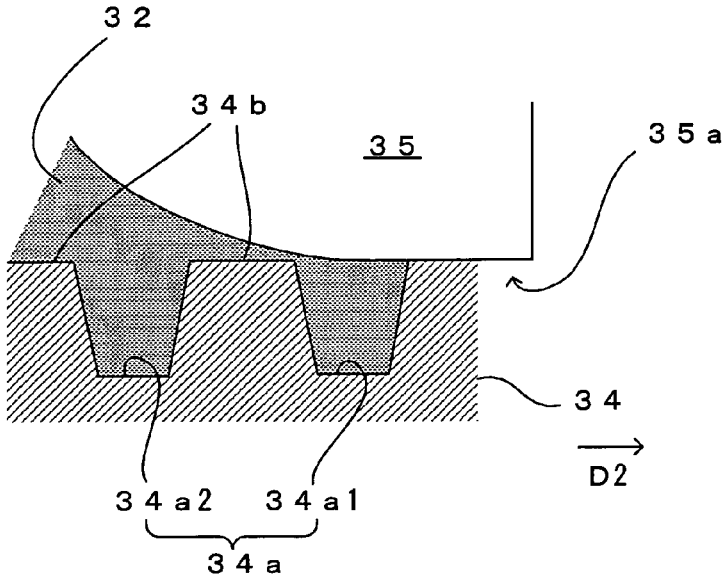
FIGS. 7A through 7C are schematic drawings which illustrate how the liquid developing agent is regulated.
Figure 7B:
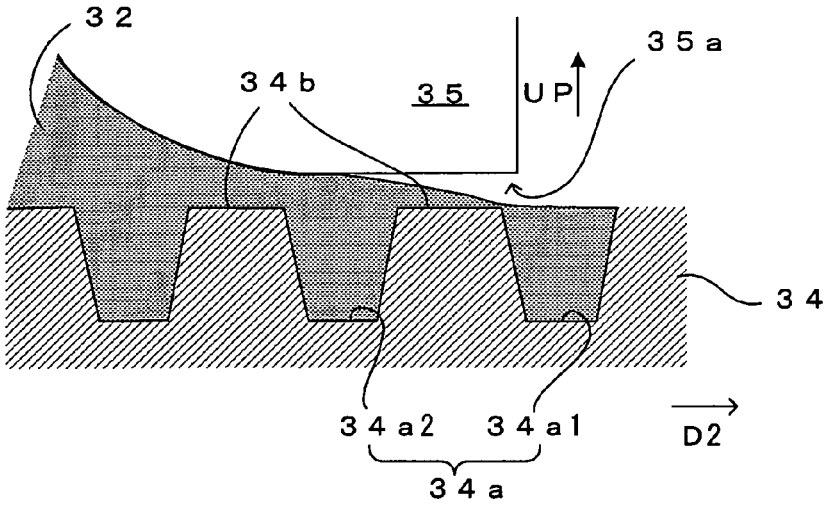
Figure 7C:
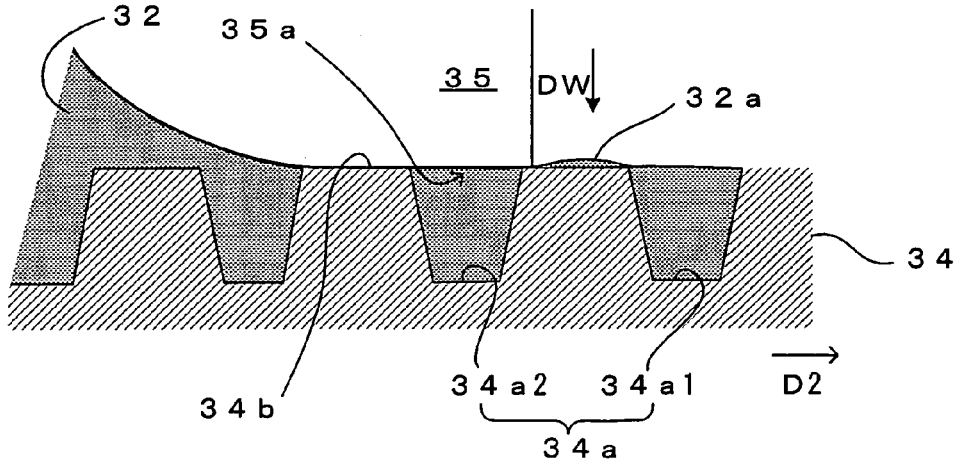
Figure 8A:
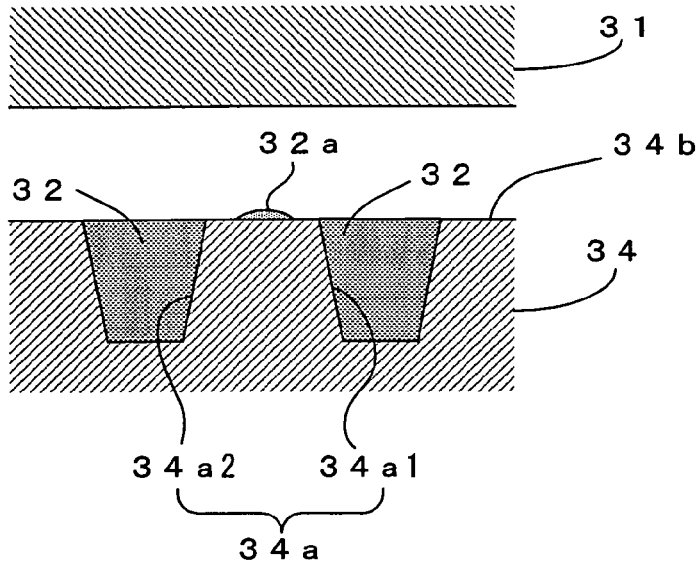
FIGS. 8A through 8C are schematic drawings which illustrate application of the liquid developing agent from the application roller to the developer roller.
Figure 8B:
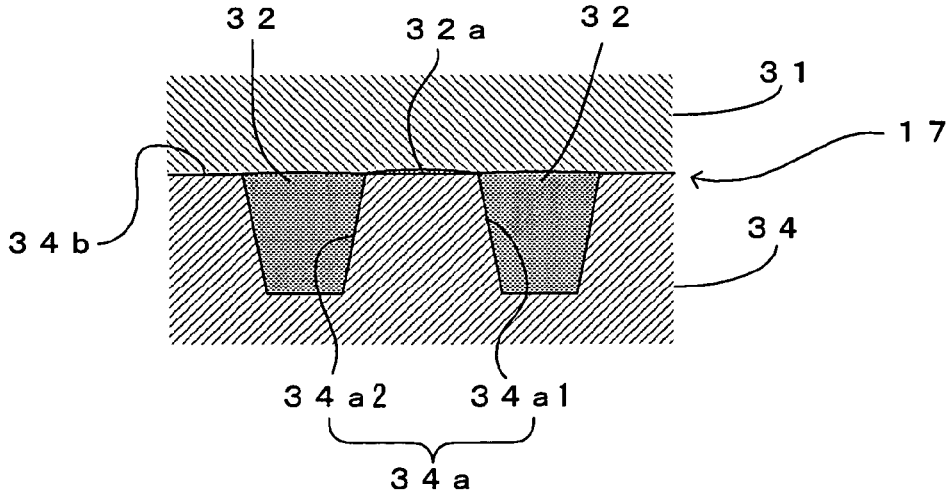
Figure 8C:
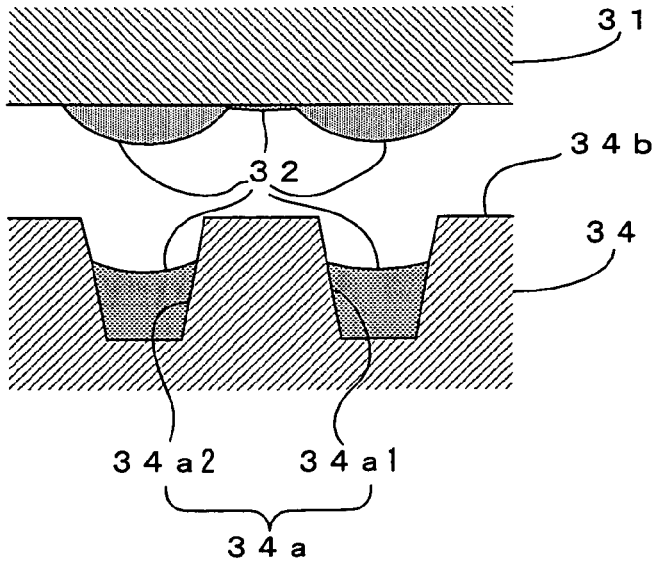

By the way, as described earlier, the inventors of the invention have found that one of the causes of a degraded image quality is a disturbed pattern of the liquid developer 32 applied by the application roller 34 upon the developer roller 31. This will now be described in detail with reference to FIGS. 6 through 8C. FIG. 6 is a partially enlarged view of the application roller and the restricting blade, FIGS. 7A through 7C are schematic drawings which illustrate how the liquid developing agent is regulated, and FIGS. 8A through 8C are schematic drawings which illustrate application of the liquid developing agent from the application roller to the developer roller. Through intensive research, the inventors of the invention have found that microvibrations of the restricting blade 35 may occur at a contact section where the application roller 34 and the restricting blade 35 contact. On that occasion, the restricting blade 35 can not completely regulate (scrape off) the liquid developer 32 which is on the peaks 34*b* within the surface of the application roller 34, and the liquid developer 32 therefore could remain seated on the peaks 34*b* in some cases. During application upon the developer roller 31 of the liquid developer 32 which is in the grooves 34*a* within the surface of the application roller 34 therefore, the liquid developer 32 which the restricting blade 35 has failed to regulate and which therefore remains on the peaks 34*b* will be applied, together with the liquid developer 32 which is in the grooves 34*a*, upon the developer roller 31. As a result, the application pattern of the liquid developer 32 applied upon the developer roller 31 is disturbed.

Further intensive research has identified that one of the causes of a disturbed pattern of the liquid developer 32 applied upon the developer roller 31 is microvibrations of the restricting blade 35 at a contact section where the application roller 34 and the restricting blade 35 contact. It is considered such microvibrations of the restricting blade 35 are attributable to the grooves 34*a* and the peaks 34*b* formed in the surface of the application roller 34, the surface roughness of the peaks 34*b* within the surface of the application roller 34, the surface roughness of a belly 35*a* of the restricting blade 35 where the restricting blade 35 contacts the application roller 34, and the like (FIG. 6). Of these causes of microvibrations, the surface roughness of the peaks 34*b* within the surface of the application roller 34 seems to be particularly influential over microvibrations of the restricting blade 35.

How the restricting blade 35 scrapes off the liquid developer 32 on the application roller 34 upon occurrence of the above microvibrations will now be described in detail with reference to FIGS. 7A through 7C. FIG. 7A illustrates the restricting blade 35 as it contacts the surface of the application roller 34 at the belly 35*a*. As the surface of the application roller 34 moves along the arrow direction D2 in accordance with rotations of the application roller 34, the restricting blade 35 scrapes off with the belly 35*a* an excessive amount of the liquid developer 32 which is on the application roller 34.

FIG. 7B illustrates the restricting blade 35 as it microvibrates while regulating (scraping off) the liquid developer 32 which is on the application roller 34. Due to the microvibrations, the restricting blade 35 moves up along the arrow direction UP during an extremely short period of time, and the belly 35*a* of the restricting blade 35 becomes clear of the surface of the application roller 34 during this extremely short period of time. At this stage, as shown in FIG. 7B, the belly 35*a* can not scrape off the liquid developer 32 held on the peak portion 34*b* which is between the groove 34*a*1 and 34*a*2.

FIG. 7C illustrates the restricting blade 35 as it moves along the arrow direction DW from the state shown in FIG. 7B and contacts at its belly 35*a* the surface of the application roller 34 again. As described above, when the belly 35*a* of the restricting blade 35 leaves the surface of the application roller 34 as the restricting blade 35 micro-vibrates, the belly 35*a* can not scrape off an excessive amount of the liquid developer 32 which is on the application roller 34. Since it is not possible for the restricting blade 35 to completely regulate (scrape off) the liquid developer 32 which is on the peaks 34*b* of the surface of the application roller 34, the liquid developer 32*a* remains carried on the peaks 34*b*.

A description will now be given while referring to FIGS. 8A through 8C on application of the liquid developer 32 upon the developer roller 31 in the condition described above that an excessive amount of the liquid developer 32 on the application roller 34 has not been completely regulated. FIG. 8A illustrates the liquid developer 32 held in the grooves 34*a* (34*a*1 and 34*a*2) of the application roller 34 and the excessive liquid developer 32*a* held on the peaks 34*b*. As shown in FIG. 8A, the application roller 34, holding the liquid developer 32 in the grooves 34*a* and carrying the excessive liquid developer 32*a* on the peaks 34*b*, transports the liquid developer 32 to the application position 17.

FIG. 8B illustrates pressure contact of the developer roller 31 and the application roller 34 at the application position 17. As the developer roller 31 contacts the application roller 34 under pressure at the application position 17, the surface rubber layer gets elastically deformed and edges into the grooves 34*a* and contacts the liquid developer 32 which is held in the grooves 34*a*.

Following this, as the application roller 34 and the developer roller 31 rotate and move, the pressure contact between the surface of the application roller 34 and the developer roller 31 is dissolved (FIG. 8C). As this occurs, as shown in FIG. 8C, the liquid developer 32*a* on the peaks 34*b* which the restricting blade 35 could not regulated moves to the developer roller 31 together with the liquid developer 32 which is held in the grooves 34*a* (34*a*1 and 34*a*2), and the liquid developer 32*a* is applied upon the developer roller 31. In this fashion, when the liquid developer 32 held in the grooves 34*a* within the surface of the application roller 34 is applied upon the developer roller 31, the liquid developer 32*a* on the peaks 34*b* creates so-called "ribs" which will disturb the pattern of the liquid developer 32 applied upon the developer roller 31.

In the first embodiment of the invention, as described earlier, the following relationship is satisfied where the surface roughness Ra of the peaks 34*b* within the surface of the application roller 34 is R1*a*, the surface roughness Ra of the grooves 34*a* is R2*a* and the surface roughness Ra of the belly 35*a* of the restricting blade 35 is R4*a*:

$$R1a<R4a<R2a \qquad \text{[Second Condition]}$$

This structure prevents the excessive liquid developer 32*a* as described above from staying on the peaks 34*b* within the surface of the application roller 34 after the application roller 34 has passed the contact section where the application roller 34 and the restricting blade 35 contact. The basic principle of the invention will now be described in detail with reference to FIGS. 9A and 9B.

Figure 9A:
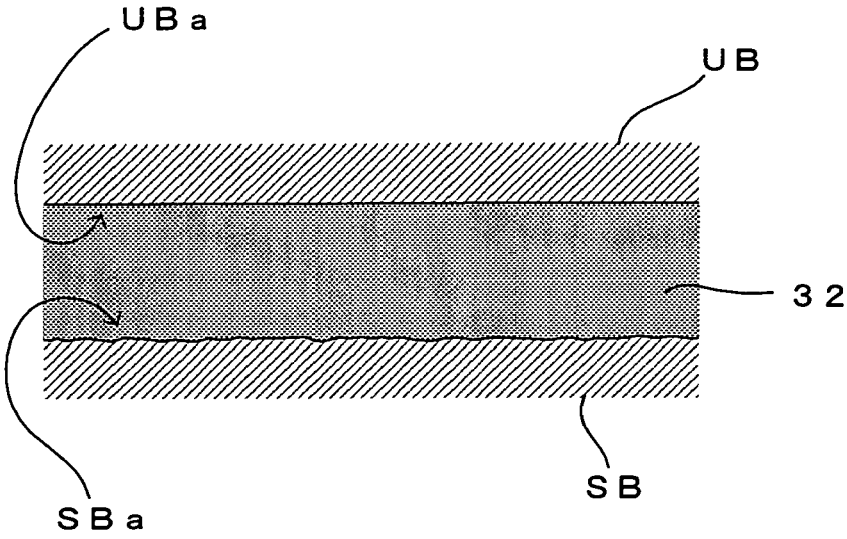
FIGS. 9A and 9B are schematic drawings which show the basic principle of the invention.
Figure 9B:
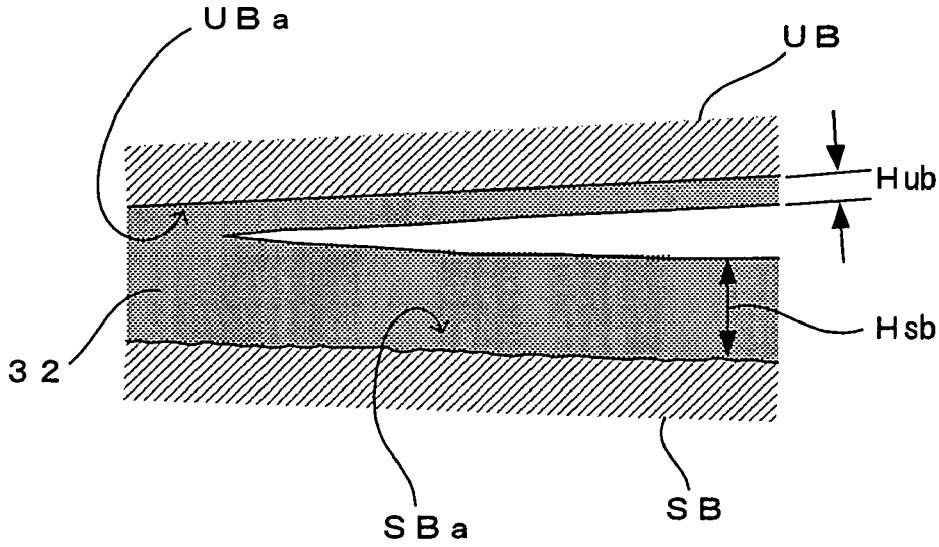

FIGS. 9A and 9B are schematic drawings which show the basic principle of the invention. FIG. 9A shows the liquid developer 32 as it is held between an upper plate UB and a lower plate SB. Assuming that the surface roughness Ra of a surface UBa of the upper plate UB which contacts the liquid developer 32 is Rub and the surface roughness Ra of a surface SBa of the lower plate SB which contacts the liquid developer 32 is Rsb, the inequality below is satisfied:

$$Rub<Rsb$$

As the upper plate UB and the lower plate SB move in a direction which separates them from each other, a greater amount of the liquid developer 32 goes with the lower plate SB whose surface roughness Ra is greater, as shown in FIG. 9B. In other words, since the surface roughness Ra of the surface UBa of the upper plate UB and the surface roughness Ra of the surface SBa of the lower plate SB satisfy the above relationship, when the upper plate UB and the lower plate SB move away from each other, the liquid developer 32 held between the upper plate UB and the lower plate SB splits away, with the thickness Hub of the liquid developer 32 carried away by the upper plate UB and the thickness Hsb (>Hub) of the liquid developer 32 carried away by the lower plate SB. This phenomenon that separation of two members which are different in surface roughness from each other and hold the liquid developer 32 between them causes a greater amount of the liquid developer 32 adhering to the member whose surface roughness is greater is one of the findings of the intensive research by the inventors of the invention.

Figure 10A:
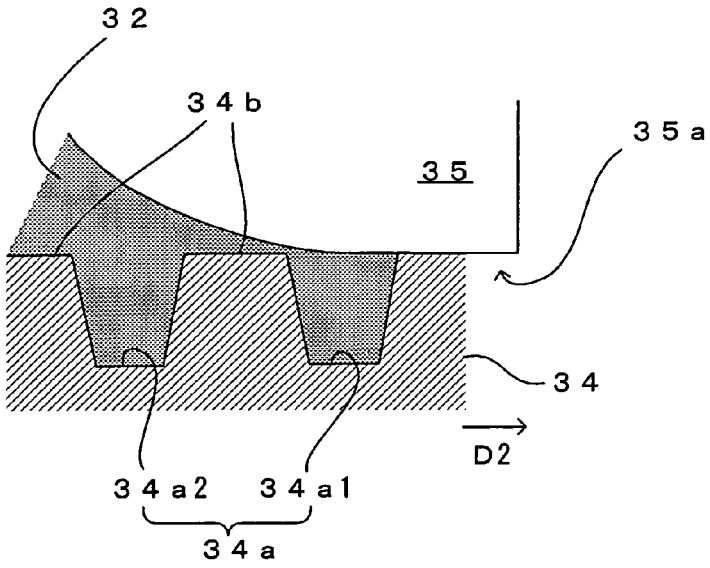
FIGS. 10A through 10C are schematic drawings which illustrate regulation of the liquid developing agent.
Figure 10B:
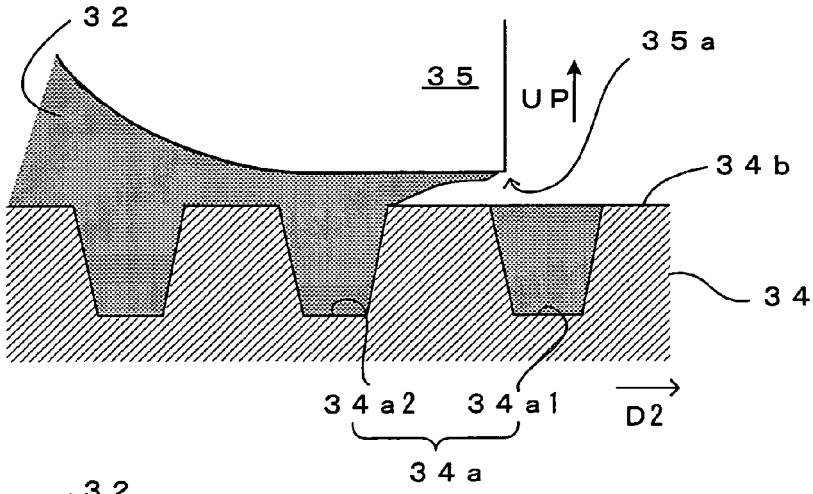
Figure 10C:
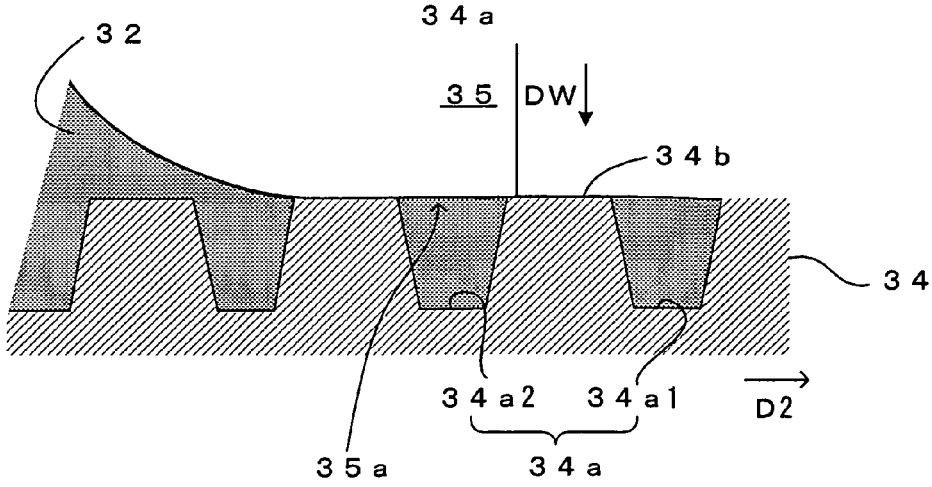

Since this embodiment satisfies the second condition above, it is possible to prevent the excessive liquid developer 32*a* from staying on the peaks 34*b* within the surface of the application roller 34 while the restricting blade 35 regulates the liquid developer 32 which is on the application roller 34, which will now be described in detail with reference to FIGS. 10A through 10C. FIGS. 10A through 10C are schematic drawings which illustrate regulation of the liquid developing agent.

FIG. 10A shows the belly 35*a* of the restricting blade 35 in contact with the surface of the application roller 34. As the application roller 34 rotates and the surface of the application roller 34 moves along the arrow direction D2, the restricting blade 35 scrapes off with its belly 35*a* an excessive amount of the liquid developer 32 which is on the application roller 34.

FIG. 10B shows the restricting blade 35 as it micro-vibrates while regulating (scraping off) the liquid developer 32 which is on the application roller 34. Due to the microvibrations, the restricting blade 35 moves up along the arrow direction UP during an extremely short period of time, and the belly 35*a* of the restricting blade 35 becomes clear of the surface of the application roller 34 during this extremely short period of time. At this stage, since the surface roughness R1*a* of the peaks 34*b* is smaller than the surface roughness R4*a* of the belly 35*a*, due to the basic principle of the invention described in detail with reference to FIGS. 9A and 9B, the majority of the liquid developer 32 carried on the peak 34*a* which is between the groove 34*a*1 and 34*a*2 moves toward the belly 35*a* of the restricting blade 35 (FIG. 10B). On the contrary, since the surface roughness R2*a* of the grooves 34*a* is larger than the surface roughness R4*a* of the belly 35*a*, the majority of the liquid developer 32 held in the grooves 34*a* will not move toward the belly 35*a* even when the belly 35*a* of the restricting blade 35 leaves the surface of the application roller 34.

FIG. 10C shows the restricting blade 35 as it moves along the arrow direction DW from the state shown in FIG. 10B and contacts at its belly 35*a* the surface of the application roller 34 again. As described above, when the belly 35*a* of the restricting blade 35 leaves the surface of the application roller 34 as the restricting blade 35 micro-vibrates, the majority of the liquid developer 32 on the peaks 34*b* opposed against the belly 35*a* moves toward the belly 35*a*. As a result, the belly 35*a* can securely scrapes off an excessive amount of the liquid developer 32 which is on the application roller 34. Since the restricting blade 35 completely regulates (scrapes off) the liquid developer 32 on the peaks 34*b* within the surface of the application roller 34, the application roller 34 carries the liquid developer 32 only in the grooves 34*a*.

As described above, this embodiment satisfies the inequality below where the surface roughness Ra of the peaks 34*b* within the surface of the application roller 34 is R1*a*, the surface roughness Ra of the grooves 34*a* is R2*a* and the surface roughness Ra of the belly 35*a* of the restricting blade 35 is R4*a*:

$$R1a<R4aR2a \qquad \text{[Second Condition]}$$

Since this satisfies R1*a*<R4*a* as well, despite the microvibrations of the restricting blade 35, the liquid developer 32 on the peaks 34*b* within the surface of the application roller 34 moves toward the belly 35*a* of the restricting blade 35 whose surface roughness is greater, and therefore, the restricting blade 35 scrapes off the liquid developer 32 without fail. In addition, since R4*a*<R2*a* is met as well, the liquid developer 32*a* held in the grooves 34*a* within the surface of the application roller 34 will not move toward the belly 35*a* of the restricting blade 35 whose surface roughness is small but remain securely carried in the grooves 34*a* whose surface roughness is great while moving passed the section in which the application roller 34 contacts the belly 35*a* of the restricting blade 35.

Further, the surface roughness R1*a* of the peaks 34*b* within the surface of the application roller 34, which is considered particularly influential over development of microvibrations of the restricting blade 35, is the smallest, which suppresses microvibrations of the restricting blade 35. Discouraged microvibrations of the restricting blade 35, which blocks an excessive amount of the liquid developer 32 on the application roller 34 from getting scraped off, makes it possible to more securely regulate the amount of the liquid developer 32 carried by the application roller 34. In consequence, at the application position 17, the restricting blade 35 regulates without fail the amount of the liquid developer 32 carried by the application roller 34 before application of the liquid developer 32 upon the developer roller 31, and the application roller 34 carries the liquid developer 32 only in the grooves 34*a* which are formed within the surface of the application roller 34. At the application position 17, the liquid developer 32 held in the grooves 34*a* alone is applied upon the developer roller 31, thereby preventing a disturbed pattern of the liquid developer 32 applied upon the developer roller 31. As an electrostatic latent image on the photosensitive member is developed with the liquid developer 32 which has been applied upon the developer roller 31 as an undisturbed pattern, a toner image is created in an excellent image quality.

Further, since this embodiment requires pressing the application roller 34 with the belly 35*a* (surface) of the restricting blade 35, it is possible to efficiently transmit this pressing force to the application roller 34 over a wide range. This in turn makes it possible to more efficiently regulate (scrape off) the liquid developer 32 carried on the peaks 34*b* within the surface of the application roller 34. Since the application roller 34 can thus apply the liquid developer 32 upon the developer roller 31 while securely regulating the liquid developer 32 which is on the peaks 34*b*, it is possible to more effectively prevent a disturbed pattern of the liquid developer 32 applied upon the developer roller 31.

Further, in this embodiment, the liquid developer 32 is held in the grooves 34*a* of the anilox roller (the application roller 34) and the liquid developer 32 measured to a constant amount is applied upon the developer roller 31. It is therefore possible to apply the liquid developer 32 accurately and uniformly upon the developer roller 31. As an electrostatic latent image on the photosensitive member can be developed with the liquid developer 32 which has been applied upon the developer roller 31 accurately and uniformly, the accuracy of development improves and the image quality of a resultant toner image enhances.

<Second Embodiment>

A major difference of the second embodiment from the first embodiment lies in the material of the restricting blade. In addition, the values of the surface roughness Ra of the peaks and the grooves of the application roller, the belly of the restricting blade and the developer roller are changed. Other structures are similar to those according to the first embodiment, and therefore, the second embodiment will now be described in detail while focusing mainly on the differences from the first embodiment. The same structures and operations as those according to the first embodiment will not be described again.

The application roller and the restricting blade according to the second embodiment have the following structures.

the surface roughness Ra of the peaks of the application roller: R1*b*≈0.01 μm the surface roughness Ra of the grooves of the application roller: R2*b*≈0.1 μm the material of the restricting blade and the surface roughness Ra of the belly: phosphor bronze in the thickness of about 0.5 mm and R4*b*≈0.05 μm the contact angle between the restricting blade and the application roller: approximately 10 degrees the regulating method: trail-type regulation the surface roughness Ra of the developer roller: R5*b*≈0.4 μm The other structures and operations are similar to those according to the first embodiment.

Like the first embodiment, the second embodiment satisfies the second condition below and therefore attains similar effects to those according to the first embodiment:

$$R1b < R4b < R2b \qquad \text{[Second Condition]}$$

<Third Embodiment>

A major difference of the third embodiment from the first and the second embodiments lies in the material of the restricting blade. In addition, the values of the surface roughness Ra of the peaks and the grooves of the application roller, the belly of the restricting blade and the developer roller are changed. Further, the third embodiment satisfies a third condition which will be described in detail later. Other structures are similar to those according to the first and the second embodiments, and therefore, the third embodiment will now be described in detail while focusing mainly on the differences from the first and the second embodiments. The same structures and operations as those according to the first and the second embodiments will not be described again.

The application roller and the restricting blade according to the third embodiment have the following structures.

the surface roughness Ra of the peaks of the application roller: R1*c*≈0.05 μm the surface roughness Ra of the grooves of the application roller: R2*c*≈0.2 μm the material of the restricting blade and the surface roughness Ra of the belly: stainless steel (SUS304) in the thickness of about 0.2 mm and R4*c*=0.1 μm the contact angle between the restricting blade and the application roller: approximately 5 degrees the regulating method: trail-type regulation the surface roughness Ra of the developer roller: R5*c*≈0.15 μm The other structures and operations are similar to those according to the first and the second embodiment.

Like the first and the second embodiments, the third embodiment satisfies the second condition below and therefore attains similar effects to those according to the first and the second embodiments:

$$R1c < R4c < R2c \qquad \text{[Second Condition]}$$

By the way, while the application roller 34 rotates clockwise, accordingly contacts the liquid developer 32 and carries the liquid developer 32 in its grooves 34*a*, the liquid developer 32 could fail to fill up the grooves 34*a* completely and air could be trapped particularly at the bottom of the grooves 34*a*. The air contained in the liquid developer 32 carried in the grooves 34*a* may move even to a front layer portion of the liquid developer 32 which is carried in the grooves 34*a*, as the application roller 34 rotates and transports the liquid developer 32 to the application position 17. This prevents favorable transfer of the liquid developer 32 held in the grooves 34*a* onto the developer roller 31, which is one of the causes of a disturbed pattern of the liquid developer 32 applied upon the developer roller 31.

With this respect, in the third embodiment, the surface roughness R2*c* of the grooves 34*a* of the application roller 34 and the surface roughness R5*c* of the developer roller 31 satisfy the relationship below:

$$R2c > R5c \qquad \text{[Third Condition]}$$

Hence, during application upon the developer roller 31 of the liquid developer 32 held in the grooves 34*a* within the surface of the application roller 34, due to the basic principle of the invention described in detail with reference to FIGS. 9A and 9B, not all of the liquid developer 32 held in the grooves 34*a* will be transferred to the developer roller 31 but a part of this liquid developer 32 will securely remain at the bottom of the grooves 34*a* since the surface roughness R2*c* of the grooves 34*a* is greater than the surface roughness R5*c* of the developer roller 31.

The liquid developer 32 remains at the bottom of the grooves 34*a* without fail while the application roller 34 rotates clockwise again, accordingly contacts the liquid developer 32 and carries the liquid developer 32 in its grooves 34*a*, which prevents air from getting trapped at the bottom of the grooves 34*a*. In short, it is possible to effective prevent trapping of air inside the grooves 34*a* while the liquid developer 32 is delivered to inside the grooves 34*a* within the surface of the application roller 34. As a result, it is possible to more effectively prevent a disturbed pattern of the liquid developer 32 applied upon the developer roller 31, as the liquid developer 32 which has completely filled up the grooves 34*a* is applied upon the developer roller 31.

<Fourth Embodiment>

Figure 11:
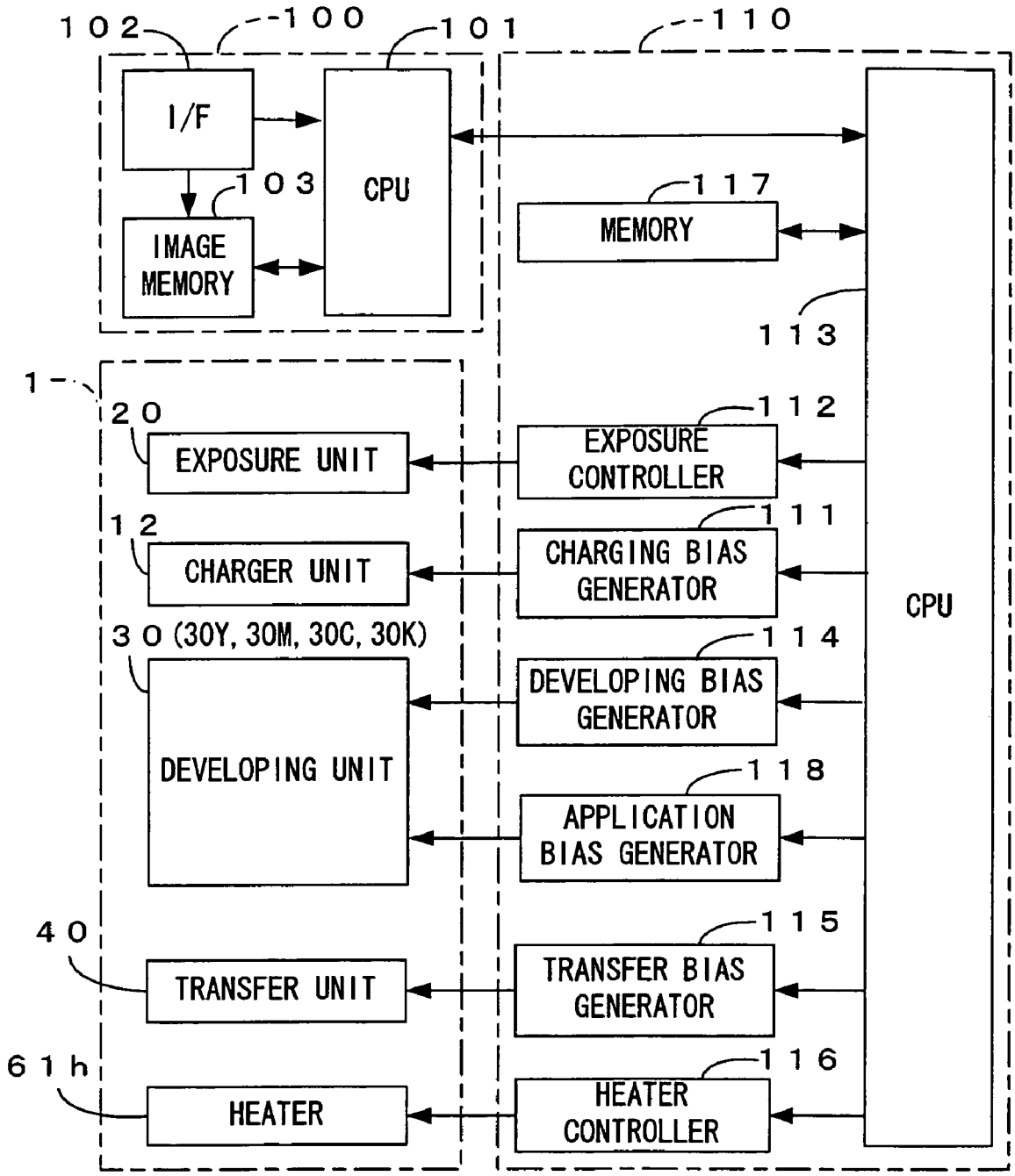
FIG. 11 is a block diagram which shows an electric structure of a printer which is the fourth embodiment.
Figure 12:
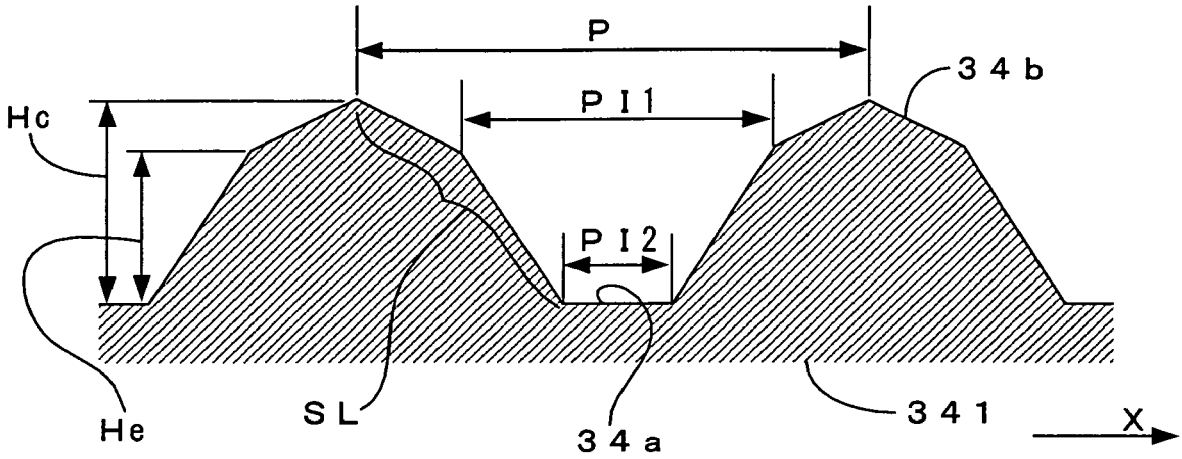
FIG. 12 is an enlarged schematic view of an anilox roller.

FIG. 11 is a block diagram which shows an electric structure of a printer which is the fourth embodiment, and FIG. 12 is an enlarged schematic view of an anilox roller. A major difference of the fourth embodiment from the first through the third embodiments is that the shape of the peaks 34*b* of the application roller 34 is different and the engine controller 110 comprises an application bias generator 118. In addition, the surface roughness values of the peaks and the grooves of the application roller are changed. Other structures are similar to those according to the first through the third embodiments, and therefore, the fourth embodiment will now be described in detail while focusing mainly on the differences from the first through the third embodiments. The same structures and operations as those according to the first through the third embodiments will not be described again.

An application roller 341 according to the fourth embodiment rotates clockwise, accordingly contacts the liquid developer 32, carries the liquid developer 32 in its grooves 34*a* and transports thus carried liquid developer 32 to the developer roller 31, as in the first through the third embodiments. Hence, the application roller 341 can apply, over its X-direction width bearing the grooves 34*a*, the liquid developer 32 upon the developer roller 31. In this embodiment, the groove pitches P are about 80 μm, the width of the peaks is about 40 μm, the width PI1 of top parts of the grooves 34*a* is about 50 μm, the width PI2 of bottom parts of the grooves 34*a* is about 30 μm, the depth He (which corresponds to "the height of the edge parts of the convex sections" of the invention) of the grooves 34*a* is about 20 μm and the height Hc (which corresponds to "the height of the central parts of the convex sections" of the invention) of the peaks 34*b* (which correspond to the "convex sections" of the invention) is about 30 μm, and inclined sections SL are provided which monotonously extend from the central parts of the peaks 34*b* to the bottom parts of the grooves 34*a* (FIG. 12). Further, in this embodiment, the surface roughness Rz of the peaks 34*b* is R1*d*≈1.0 μm and the surface roughness Rz of the grooves 34*a* is R2*d*≈1.0 μm. It is also ensured that the film thickness of the liquid developer 32 applied upon the developer roller 31 will be about 15 μm as a result of application of all liquid developer 32 held in the grooves 34*a* of the application roller 341 upon the developer roller 31.

The application roller 341 is electrically connected with the application bias generator 118 (which corresponds to the "bias applier" of the invention) so that the application bias generator 118 can apply the application bias upon the application roller 341 (FIG. 11). In the event that the toner particles in the liquid developer 32 are charged positively owing to the effect exerted by the charge controlling agent or the like, for instance, the application bias of DC+600 V may be applied upon the application roller 341, to thereby move the toner particles in the liquid developer 32 carried by the application roller 341 toward the front surface of the liquid developer 32 (i.e., toward the surface of the application roller 341) and adjust dispersion of the toner particles in the liquid developer 32.

Figure 13A:
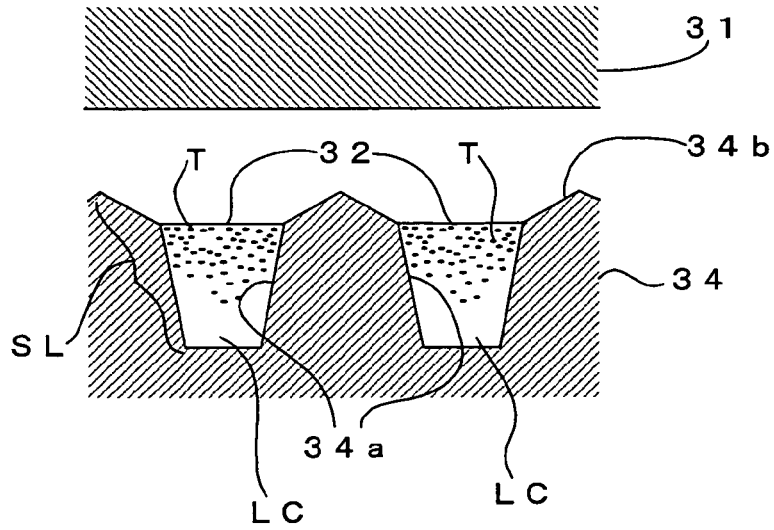
FIGS. 13A through 13C are schematic drawings which illustrate application of the liquid developing agent from the application roller to the developer roller.

A detailed description will now be given with reference to FIGS. 13A through 13C on how the liquid developer 32 moves from the application roller 341 to the developer roller 31 within the developing unit 30Y having the above structure. FIG. 13A shows the liquid developer 32 (the carrier liquid LC and the toner particles T) as it is held in the grooves 34*a* of the application roller 341. As shown in FIG. 13A, while carrying the liquid developer 32 in its grooves 34*a*, the application roller 341 transports the liquid developer 32 to the application position 17. Further, in this embodiment, due to an electric field generated by the application bias applied by the application bias generator 118, the toner particles T are dispersed in the carrier liquid LC with a higher concentration toward the front surface side, that is, toward the front surface of the application roller 341.

Figure 13B:
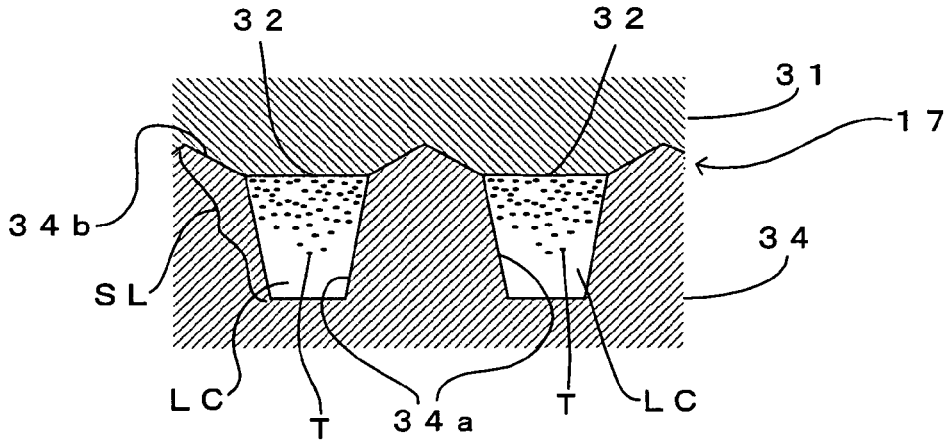

FIG. 13B shows the developer roller 31 and the application roller 341 in pressure contact with each other at the application position 17. While remaining in pressure contact with the application roller 341, the developer roller 31 contacts the liquid developer 32 which is held in the grooves 34*a*.

Figure 13C:
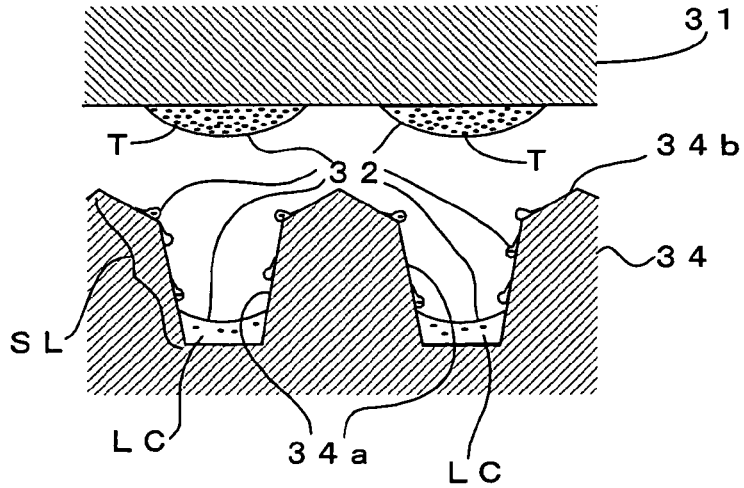

Following this, as the application roller 341 and the developer roller 31 rotate and move, the pressure contact between the surface of the application roller 341 and the developer roller 31 is dissolved (FIG. 13C). As this occurs, as shown in FIG. 13C, the liquid developer 32 moves to the surface of the developer roller 31 from the grooves 34*a* and is applied uniformly upon the surface of the developer roller 31. While this proceeds, the liquid developer 32 remaining on the application roller 341 without getting transferred to the developer roller 31, due to its own gravity, moves to the bottom parts of the grooves 34*a* along the inclined sections SL formed in the application roller 341. The liquid developer 32 (the carrier liquid LC and the toner particles T) remaining on the application roller 341 without getting transferred to the developer roller 31 moves due to its own gravity and thus stays at the bottom parts of the grooves 34*a*.

As described above, in this embodiment, the application roller 341 comprises the inclined sections SL which monotonously extend from the central parts of the peaks 34*b* to the bottom parts of the grooves 34*a*. Hence, during application of the liquid developer 32 upon the developer roller 31, the liquid developer 32 (the carrier liquid LC and the toner particles T) remaining on wall surfaces of the grooves 34*a* and the like of the application roller 341 instead of moving to the developer roller 31 from the application roller 341 and the liquid developer 32 adhering to the peaks 34*b*, due to their gravity, move to the bottom parts of the grooves 34*a*. As a result, the liquid developer 32 which has not get transferred from the application roller 341 to the developer roller 31 (element-to-be-coated) remains at the inner bottom parts of the grooves 34*a* which are provided within the surface of the application roller 34. As this assures that there already is always the liquid developer 32 at the bottom parts of the grooves 34*a* when the further liquid developer 32 is delivered to the grooves 34*a* within the surface of the application roller 34, no air will be trapped at the bottom of the grooves 34*a*. In other words, it is possible to hold an appropriate amount of the liquid developer 32 since trapping of air in the grooves 34*a* is prevented effectively when the liquid developer 32 is delivered to the grooves 34*a* which are formed within the surface of the application roller 34.

Further, in the developing unit 30 according to this embodiment, the developer roller 31 receives the liquid developer 32 measured to a correct amount by the application roller 341 which prevents trapping of air in the grooves 34*a*. This obviates a disturbed pattern of the liquid developer 32 applied upon the developer roller 31. It is therefore possible to improve the accuracy of development and enhance the image quality of a toner image, as an electrostatic latent image on the photosensitive member is developed with the liquid developer 32 uniformly applied upon the developer roller 31.

This embodiment further achieves the following unique benefit. That is, the application roller 341 comprises the inclined sections SL which monotonously extend from the central parts of the peaks 34*b* to the bottom parts of the grooves 34*a*. Contacting the peaks 34*b*, the restricting blade 35 scrapes off an excessive amount of the liquid developer 32 which is on the application roller 341, namely, the liquid held on the peaks 34*b*. At this stage, there is a possibility that the restricting blade 35 fails scraping off the liquid developer 32 which is on the peaks 34*b* and the liquid developer 32, though in a very small amount, remains on the peaks 34*b*. Even when this occurs, the inclined sections SL formed in the application roller 341 assure that the very small amount of the liquid developer 32 which remains will move from the peaks 34*b* to the grooves 34*b* due to its own gravity. This achieves a condition that no liquid developer 32 is left on the peaks 34*b* of the application roller 341 before the liquid developer 32 carried at the application position 17 is applied upon the developer roller 31. This prevents transfer of the liquid developer 32 on the peaks 34*b* to the developer roller 31 and hence linking of the liquid developer 32 held in the grooves 34*a* which are on the both sides of the peaks 34*b* to each other on the developer roller 31 when this liquid developer 32 is applied upon the developer roller 31. This attains effective prevention of a disturbed pattern of the liquid developer 32 applied upon the developer roller 31. It is therefore possible to improve the accuracy of development and enhance the image quality of a toner image, as an electrostatic latent image on the photosensitive member is developed with the liquid developer 32 which has been uniformly applied upon the developer roller 31 as an undisturbed pattern.

Further, in this embodiment, the liquid developer 32 is obtained by dispersing the toner particles T in the carrier liquid LC. This brings about the effect described in detail below. That is, the carrier liquid LC contained in the liquid developer 32 which remains on the surface of the application roller 341 after applied upon the developer roller 31 tends to move toward the bottom parts of the grooves 34*a* than the solid toner particles T would. Due to this, the carrier liquid LC component builds up at the bottom parts of the grooves 34*a* on the application roller 341, and the toner particles T move onto thus accumulated carrier liquid LC component. Since an aggregation of the toner particles T consequently appears near the surface of the application roller 341, it is possible to efficiently transfer the toner particles T contained in the liquid developer 32 to the developer roller 31 during application of the liquid developer 32 upon the developer roller 31 from the application roller 341.

Further, in this embodiment, an electric field generated by the application bias applied upon the application roller 341 by the application bias generator 118 adjusts dispersion of the toner particles T in the liquid developer 32. In other words, as the electric field acts upon the toner particles T contained in the liquid developer 32 held in the grooves 34*a* of the application roller 341, the toner particles T are dispersed in a higher concentration toward the surface of the application roller 341. Hence, when the application roller 341 applies the liquid developer 32 upon the developer roller 31, the toner particles T contained in the liquid developer 32 are more efficiently transferred to the developer roller 31.

Further, this embodiment satisfies the relationships below where the surface roughness Rz of the peaks 34*b* is R1*d*, the surface roughness Rz of the grooves 34*a* is R2*d* and the average diameter Dr of the toner particles is R3*d*:

$$R3d > R2d$$

$$R3d > R1d$$

Setting the surface roughness Rz of the peaks 34*b* and that of the grooves 34*a* smaller than the average diameter Dr of the toner particles T realizes the unique effects described in detail below. That is, it is possible to prevent the toner particles T from getting caught by and staying on the surfaces of the peaks 34*b* and to accordingly secure movements of the toner particles T toward the grooves 34*a*. In addition, it is possible to effectively prevent the toner particles T from getting caught by the inner wall surfaces of the grooves 34*a* and remaining in the grooves 34*a* during transfer (application) upon the developer roller 31 of the liquid developer 32 which is held in the grooves 34*a*.

<Fifth Embodiment>

Figure 14:
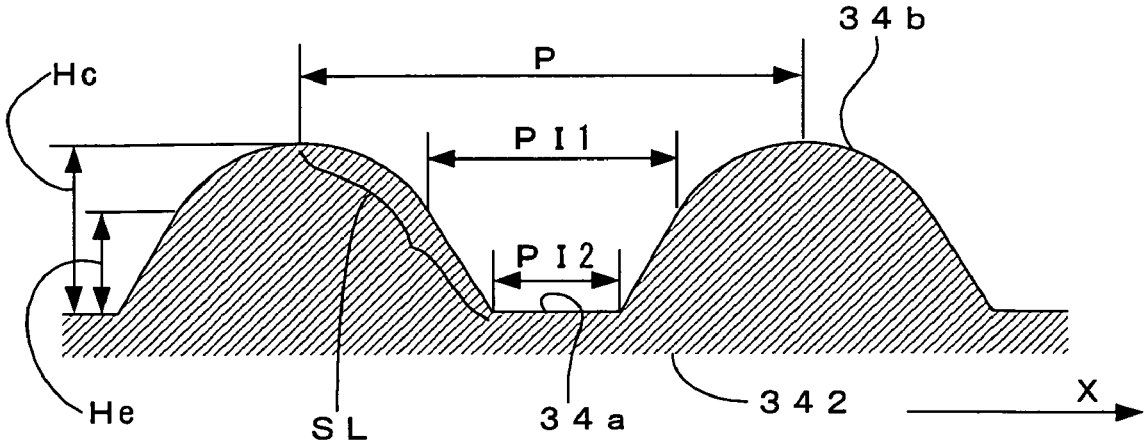
FIG. 14 is an enlarged schematic view of the fifth embodiment of the anilox roller according to the invention.

FIG. 14 is an enlarged schematic view of the fifth embodiment of the anilox roller according to the invention. A major difference of the fifth embodiment from the fourth embodiment lies in the structures of the peaks 43*b* and the grooves 34*a* of an application roller 342. Further, in this embodiment, the grooves 34*a* and the peaks 43*b* are formed on the application roller 342 by the so-called rolling process. Still further, after forming the grooves 34*a* and the peaks 43*b* by rolling, very small flashes remaining on the peaks 43*b* are polished off by the so-called shot blast method and the peaks 43*b* are made smooth. Another difference is the average diameter of the toner particles contained in the liquid developer as compared to those according to the first through the fourth embodiments. Other structures are similar to those according to the first through the fourth embodiments, and therefore, the fifth embodiment will now be described in detail while focusing mainly on the differences from the fourth embodiment. The same structures and operations as those according to the first through the fourth embodiments will not be described again.

The application roller 342 of this embodiment has the following structure.

the surface roughness Rz of the peaks of the application roller: R1*e*≈0.5 μm the surface roughness Rz of the grooves of the application roller: R2*e*≈1.0 μm the average diameter Dr of the toner particles: R3*e*≈1.5 μm the width of the peaks: approximately 40 μm the groove pitches P: approximately 80 μm the width PI1 of top parts of the grooves: approximately 50 μm the width PI2 of bottom parts of the grooves: approximately 30 μm the depth He of the grooves: approximately 20 μm the height Hc of the peaks: approximately 30 μm the film thickness of the liquid developer applied upon the developer roller: approximately 14 μm Described above as the film thickness of the liquid developer applied upon the developer roller is a value as it is where all liquid developer 32 held in the grooves 34*a* of the application roller 342 is applied upon the developer roller. The other structures and operations are similar to those according to the fourth embodiment. Hence, on top of the effects according to the fourth embodiment, the following effects are achieved as well.

The fifth embodiment satisfies the relationship below:

$$R2e > R1e$$

where the surface roughness Rz of the peaks 34*b* of the application roller is R1*e* and the surface roughness Rz of the grooves 34*a* of the application roller is R2*e*. The larger surface roughness Rz of the grooves 34*a* prevents the liquid developer 32, once held in the grooves 34*a*, from moving toward the peaks 34*b*.

Further, in this embodiment, the application roller 342 is formed such that the peaks 34*b* have curved shapes. The curved shapes of the peaks 34*b* effectively suppresses damaging of the developer roller at the time of contact between the peaks 34*b* and the developer roller (element-to-be-coated).

<Sixth Embodiment>

Figure 15:
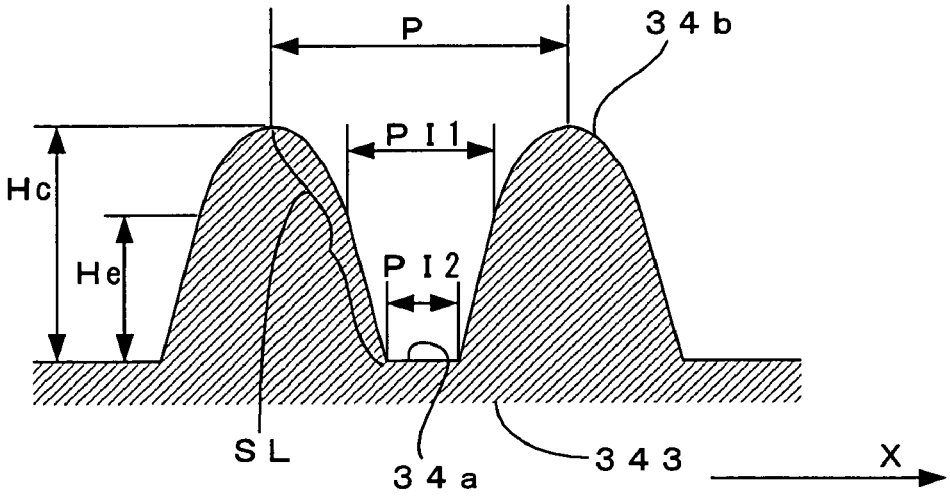
FIG. 15 is an enlarged schematic view of the sixth embodiment of the anilox roller according to the invention.

FIG. 15 is an enlarged schematic view of the sixth embodiment of the anilox roller according to the invention. A major difference of the sixth embodiment from the fifth embodiment lies in the structures of the peaks 43*b* and the grooves 34*a* of an application roller 343. Further, in this embodiment, the grooves 34*a* and the peaks 43*b* are formed on the application roller 343 by the so-called rolling process. Still further, after forming the grooves 34*a* and the peaks 43*b* by rolling, very small flashes remaining on the peaks 43*b* are polished off by the so-called electropolishing method and the peaks 43*b* are made smooth. Another difference is the average diameter of the toner particles contained in the liquid developer as compared to that according to the fifth embodiment. Other structures are similar to those according to the fifth embodiments, and therefore, the sixth embodiment will now be described in detail while focusing mainly on the differences from the fifth embodiment. The same structures and operations as those according to the first through the fifth embodiments will not be described again.

The application roller 343 of this embodiment has the following structure.

the surface roughness Rz of the peaks of the application roller: R1*f*≈0.05 μm the surface roughness Rz of the grooves of the application roller: R2*f*≈0.5 μm the average diameter Dr of the toner particles: R3*f*≈0.8 μm the width of the peaks: approximately 24 μm the groove pitches P: approximately 60 μm the width PI1 of top parts of the grooves: approximately 36 μm the width PI2 of bottom parts of the grooves: approximately 20 μm the depth He of the grooves: approximately 25 μm the height Hc of the peaks: approximately 30 μm the film thickness of the liquid developer applied upon the developer roller: approximately 17.7 μm Described above as the film thickness of the liquid developer applied upon the developer roller is a value as it is where all liquid developer 32 held in the grooves 34*a* of the application roller 342 is applied upon the developer roller. The other structures and operations are similar to those according to the fourth embodiment. Hence, the effects according to the fourth embodiment are achieved as well.

<Seventh Embodiment>

Figure 16:
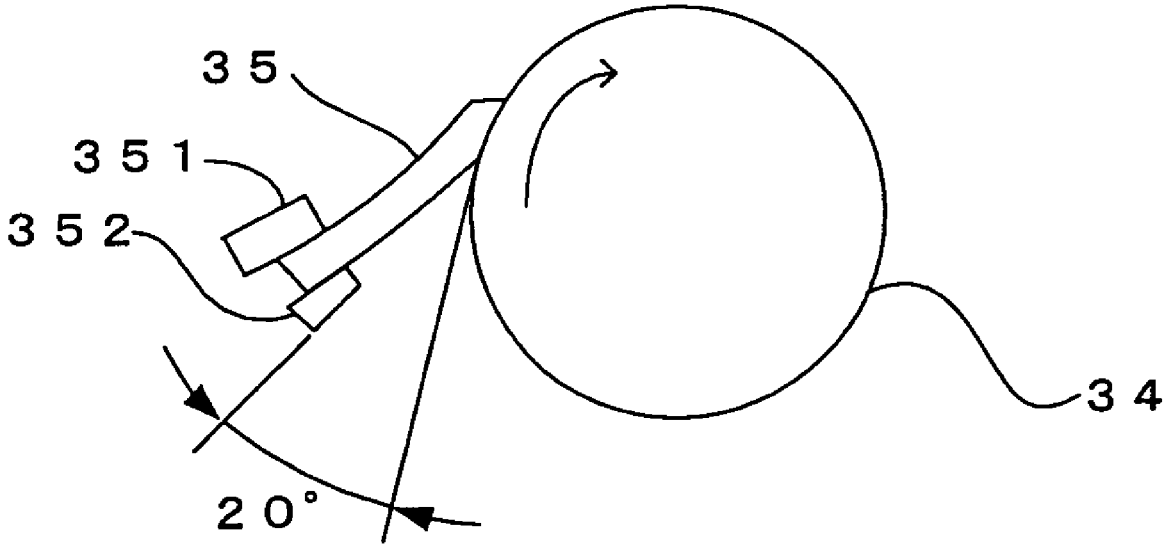
FIG. 16 is an enlarged view which shows an essential part of the seventh embodiment of the image forming apparatus.

FIG. 16 is an enlarged view which shows an essential part of the seventh embodiment of the image forming apparatus according to the invention. A major difference of this embodiment from the first through the sixth embodiments is that a support member 351 which supports the restricting blade further comprises an adjustment member 352. Other structures are similar to those according to the first through the sixth embodiments. The seventh embodiment will now be described in detail while focusing mainly on the differences from the first through the sixth embodiments. The same structures and operations as those according to the first through the sixth embodiments will not be described again.

In the seventh embodiment, the support member 351 which supports the restricting blade 35 further comprises the adjustment member 352, and where a contact angle is defined as an angle between the tangent line of the outer peripheral surface of the application roller 34 (341 through 343) and the belly of the restricting blade 35 at the contact position of the restricting blade 35 and the application roller 34 (341 through 343), the contact angle can be adjusted freely within the range from 0 to 45 degrees by adjusting the adjustment member 352. In this embodiment, the adjustment member 352 is adjusted so as to achieve the contact angle of about 20 degrees.

Adjustment of the contact angle permits the restricting blade 35 flex with any desired force, which in turn makes it possible to freely adjust the elastic force of the restricting blade 35. It is therefore possible to freely adjust the force with which the restricting blade 35 pushes the application roller 34 (341 through 343). This allows any desired adjustment of the force with which the restricting blade 35 pushes the application roller 34 (341 through 343) in accordance with the structure of the application roller 34 (341 through 343), the structure of the restricting blade 35 (the elastic force, etc.), and the like. Hence, by means of any desired adjustment of the force with which the restricting blade 35 pushes the application roller 34 (341 through 343) in light of the structures of the application roller 34 (341 through 343) and the restricting blade 35, the liquid developer 32 carried on the surface of the application roller 34 (341 through 343) is regulated (scraped off) more efficiently. This establishes more effective prevention of a disturbed pattern of the liquid developer 32 applied upon the developer roller 31.

<Others>

The invention is not limited to the embodiments described above but may be modified in various manners in addition to the embodiment above, to the extent not deviating from the object of the invention. For instance, the surface roughness values Ra and Rz and the shapes of the grooves described above are not limiting but may be set in accordance with manufacturing conditions, the materials used, etc. When fabricated while properly combining the conditions above depending upon the circumstance, the apparatus is capable of forming a toner image in an excellent image quality more efficiently and effectively.

Although the first through the seventh embodiments described above require disposing the exposure unit 20 one each for each one of the photosensitive members 11Y, 11M, 11C and 11K and forming an electrostatic latent image on each one of the photosensitive members 11Y, 11M, 11C and 11K, an alternative structure may be used instead that there is only one exposure unit and as a mirror or the like switches the direction in which a laser beam is irradiated, and an electrostatic latent image is created on each one of the photosensitive members 11Y, 11M, 11C and 11K. Further alternatively, an exposure unit which uses an LED array may be used, or a latent image writer which performs so-called charging for writing may be used. To be noted is that any structure may be used to the extent it is possible to create an electrostatic latent image on each one of the photosensitive members 11Y, 11M, 11C and 11K.

Although the first through the seventh embodiments described above require that the restricting blade 35 provides trail-type regulation, this may be replaced with so-called counter regulation which is attained by an arrangement that the front tip of the restricting blade 35 is directed toward the upstream side along the direction in which the application roller rotates. Further, the regulating member of the invention may be formed by a regulation roller. It is important to note that the invention is applicable to any regulating member which contacts the application roller and regulates the amount of the liquid developer which is on the application roller.

The structure according to the seventh embodiment may be used in the first through the sixth embodiments. Since this allows freely changing the contact angle between the restricting blade and the application roller in accordance with the elastic moduli of the various materials which form the restricting blade and other factors, it is possible for the restricting blade to more effectively regulate the amount of the liquid developing agent which is on the application roller.

In the event that the restricting blade is made of rubber such as urethane rubber, since this rubber blade is manufactured by molding, its surface may become smooth and its surface roughness Ra may fail to meet the second condition. An effective solution to this is a "test run" which may be executed at the time of a first power-on after the purchase of the apparatus or executed as an initial drive operation upon exchange of the restricting blade. A "test run" shags the contact section of the restricting blade with the application roller 34 because of the force of frictional contact between the restricting blade and the application roller 34. By the time of actual use therefore, the surface roughness Ra of the belly of the restricting blade becomes satisfying the second condition, thereby promising similar effects to, those according to the first through the third embodiments.

The structure of the developer roller, the material and the hardness of the restricting blade and others are not limited to those according to the embodiments above. For example, the developer roller may be replaced with a developer belt, a developer sleeve, etc. As for the material of the restricting blade, a blade spring of phosphor bronze or stainless steel may be used for instance.

Although the application roller of the invention carries a liquid developing agent as the liquid in the fourth through the sixth embodiments, the liquid to be carried is not limited to a liquid developing agent. Various types of liquids may be carried depending upon the intended use. Further, while the foregoing has described that the application roller of the invention is realized inside the image forming apparatus, the apparatus which realizes the application roller is not limited to this. The application roller of the invention may be used in any apparatus in general which creates a thin liquid film on an element-to-be-coated.

Although the embodiments above are directed to application of the invention to a tandem-type color printer, the structure according to the invention is applicable also to what is called a monochrome printer.

Further, although the foregoing has described the embodiments in relation to a printer which prints on a transfer paper an image fed from an external apparatus such as a host computer, the invention is not limited to this but may be generally applied also to any electrophotographic image forming apparatus such as a copier machine and a facsimile machine. In short, the invention is generally applicable to any image forming apparatus in which a liquid developing agent obtained by dispersing toner particles in a carrier liquid is first carried by an application roller and then regulated by a regulating member, thus regulated liquid developing agent is applied upon a liquid developer carrier, and with the liquid developing agent applied upon the liquid developer carrier, an electrostatic latent image on a latent image carrier is developed.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus comprising:

(a) a latent image carrier that carries an electrostatic latent image; and (b) a developing unit that comprises (b-1) an application roller that transports a liquid developing agent, obtained by dispersing toner particles in a carrier liquid, to an application position, at which said application roller contacts an element-to-be-coated, while carrying said liquid developing agent on its surface, and applies said liquid developing agent upon said element-to-be-coated, the roller comprising:

concave sections which are formed in the surface and carry said liquid developing agent;

convex sections which are formed in the surface; and inclined sections which monotonically extend from top parts of said convex sections to bottom parts of said concave sections, wherein the height of the top parts of said convex sections measured from bottom parts of said concave sections is higher than the height of edge parts of said convex sections;

(b-2) a regulating member that contacts said application roller, scrapes off an excessive amount of said liquid developing agent carried on said application roller and regulates the amount of said liquid developing agent carried on said application roller, and (b-3) a liquid developer carrier upon which said application roller applies said liquid developing agent that has been regulated by said regulating member, and that develops said electrostatic latent image on said latent image carrier with said liquid developing agent carried on said liquid developer carrier, thereby forming a toner image, wherein a condition of R3>R2>R1 is satisfied where R1 denotes a surface roughness of said convex sections, R2 denotes a surface roughness of said concave sections and R3 denotes a diameter of said toner particles.

2. An image forming apparatus which develops an electrostatic latent image on a latent image carrier using a liquid developing agent which is carried on a liquid developer carrier and which forms a toner image, the apparatus comprising:

(a) an application roller which is disposed for free rotations along a first direction, has concave sections and convex sections in a surface of said application roller, transports said liquid developing agent to an application position, at which said application roller contacts said liquid developer carrier, while carrying said liquid developing agent in said concave sections and applies said liquid developing agent upon said liquid developer carrier; and (b) a regulating member which is disposed in contact with said application roller on an upstream side along the first direction relative to said application position and which regulates an amount of said liquid developing agent carried on said application roller, wherein a condition of R1<R4<R2 is satisfied where R1 denotes a surface roughness of said convex sections within said surface of said application roller, R2 denotes a surface roughness of said concave sections and R4 denotes a surface roughness of a portion of said regulating member which contacts at least said application roller.

3. The image forming apparatus of claim 2, wherein a condition of R2>R5 is satisfied where R5 denotes a surface roughness of a portion of said liquid developer carrier which contacts said application roller.

4. The image forming apparatus of claim 2, wherein said regulating member is a restricting blade whose belly contacts said application roller.

5. The image forming apparatus of claim 4, further comprising a support member which supports said restricting blade, wherein said support member is capable of adjusting, within a range from 0 to 45 degrees, a contact angle which is an angle between a tangent line of an outer peripheral surface of said application roller and said belly of said restricting blade at a contact position of said restricting blade and said application roller.

6. The image forming apparatus of claim 2, wherein said application roller is an anilox roller whose surface has concave sections and convex sections, said application roller, carrying said liquid developing agent in said concave sections, transports said liquid developing agent.

* * * * *